US006525237B1

(12) United States Patent
Purdon et al.

(10) Patent No.: US 6,525,237 B1
(45) **Date of Patent: *Feb. 25, 2003**

(54) BROAD SPECTRUM DECONTAMINATION FORMULATION AND METHOD OF USE

(75) Inventors: J. Garfield Purdon, Medicine Hat (CA); Claude L. Chenier, Medicine Hat (CA); Andrew F. H. Burczyk, Redcliff (CA)

(73) Assignee: Her Majesty the Queen as represented by the Minister of National Defence of Her Majesty's Canadian Government, Ottawa (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/504,932

(22) Filed: Feb. 16, 2000

Related U.S. Application Data

(60) Provisional application No. 60/120,971, filed on Feb. 19, 1999.

(51) Int. Cl.[7] ..... G21F 9/00; A62D 3/00; F42B 33/00

(52) U.S. Cl. ..... 588/200; 588/20; 510/110; 510/420; 510/426; 510/435; 510/509

(58) Field of Search ..... 510/110, 420, 510/426, 435, 509; 588/20, 200

(56) References Cited

U.S. PATENT DOCUMENTS

| | | | | |
|---|---|---|---|---|
| 4,543,872 A | | 10/1985 | Graham et al. | 86/1 B |
| 4,589,341 A | | 5/1986 | Clark et al. | 102/303 |
| 4,744,917 A | | 5/1988 | Scardera et al. | 252/187.28 |
| 4,908,215 A | | 3/1990 | Perlman | 424/661 |
| 5,723,095 A | | 3/1998 | Fricker et al. | 422/292 |
| 5,760,089 A | | 6/1998 | Cronce | 514/643 |
| 5,859,064 A | | 1/1999 | Cronce | 514/643 |
| 5,864,767 A | | 1/1999 | Drumgoole et al. | 588/202 |
| 6,001,791 A | * | 12/1999 | Hemm et al. | 510/221 |
| 6,405,626 B1 | * | 6/2002 | Bureaux et al. | 86/50 |

FOREIGN PATENT DOCUMENTS

| | | |
|---|---|---|
| CA | 1104028 | 6/1981 |
| DE | 27 43 910 A | 4/1978 |

(List continued on next page.)

OTHER PUBLICATIONS

Ohmura et al., JP Patent Application, JP52–71592A, English Abstract from EPO, "Production Process for Reclaimed Nylon Resin", Published Jun. 15, 1977.

(List continued on next page.)

*Primary Examiner*—Yogendra N. Gupta
*Assistant Examiner*—Brian P. Mruk
(74) *Attorney, Agent, or Firm*—Nixon & Vanderhye P.C.

(57) ABSTRACT

A decontamination formulation is provided which is effective against a broad spectrum of chemical and biological warfare agents and radioactive dusts, comprising an active decontamination agent, a co-solvent, a buffer system to optimize the initial reaction pH above 8.5 and more preferably in the range of 10 to 11 for favoring oxidation of VX and HD and hydrolysis of G agents, and a surfactant similar to fire-fighting foaming agent. Formulations comprise, in water by weight, 1% to 15% of a hydrated chloroisocyanuric acid salt, 1% to 10% of a polypropylene glycol co-solvent, 1% to 15% surfactant and a buffer system to initially maintain said formulation at a pH from about 11 to about 8.5 for sufficient duration to effect decontamination. The formulation can be provided in kit form or concentrate form, be prepared, in part, in advance or on site, and be dispensed in foam form which aids in coating and adhering of the decontamination formulation to contaminated surfaces. All ingredients can be pumped through a foam nozzle or water, co-solvent and surfactant can be pumped to the nozzle with solutions of buffer and of active ingredient being introduced at the nozzle for minimizing pump exposure.

42 Claims, 15 Drawing Sheets

FOREIGN PATENT DOCUMENTS

| | | | |
|---|---|---|---|
| EP | A-0 526 305 | | 7/1992 |
| EP | WO 00/48684 | * | 8/2000 |
| EP | WO 00/51687 | * | 9/2000 |
| JP | 56 143300 | | 11/1981 |
| JP | 11-148098 | | 6/1999 |
| KR | 9 309 035 | | 9/1993 |
| WO | WO 98/30861 | | 7/1998 |

OTHER PUBLICATIONS

Yamasaki et al., JP Patent Application, JP11–148098A, English Abstract from EPO, "Solid Sterilizing Detergent for Hard Body", published Jun. 2, 1999.

Yang et al., "Decontamination of Chemical Warfare Agents", Chem. Rev. 1992, 92, pp. 1729–1743 No Month Given.

NBC Defence &Technology International, Decontamination, 1987 Yearbook, pp. 29–30 No Month Given.

NBC Defence & Technology International, Chemical Warfare: Part 1—Chemical Decontamination, vol. 1, No. 4, pp. 59–65, About 1985 No Month Given.

K.G. Benz, NBC Defence—an overview, Part 2: Detection and Decontamination, Internal Defence Review, IDR, About 1983 No Month Given.

Stelzmuller, NBC Defence—A German Viewpoint, Nov. 1982.

Yang et al., Edgewood Research, Development & Engineering Center, Decontamination of Chemical Warfare Agents, Dec. 1992.

H. Yuichi; Japanese Patent Abstract, Publication No. 11148098, published Jun. 2, 1999.

Patent Abstract; "Regenerate Nylon Producd Blreach Waste Fish Net Fuse Mould", Mitsubishi Chem Ind Ltd Jun. 15, 1997.

JP 52 071592 (Mitsubishichem Ind Ltd) Database WPI, Section Ch, Week 197730, Derwent Publications Ltd., London, GB; AN 1977–53259Y, XP002134423. Jun 15, 1977.

KR9 309 035 B (Rcs Inst Nat Defence) Database WPI, Section Ch, Week 199436, Derwent Publications Ltd., London, GB; An 1994–291518, XP002134427, Sep. 22, 1993.

Patent Abstracts of Japan, vol. 006, No. 019 (C–090), Feb. 3, 1982 & JP 56 143226 A (Kao Corp), Nov. 7, 1981.

Database WPI, Section Ch., Week 198151, Derwent Publications Ltd., London, GB; AN 1981–93944D, XP002134424 & JP 56 143300 A(Kao Soap Co Ltd), Nov. 7, 1981.

* cited by examiner-

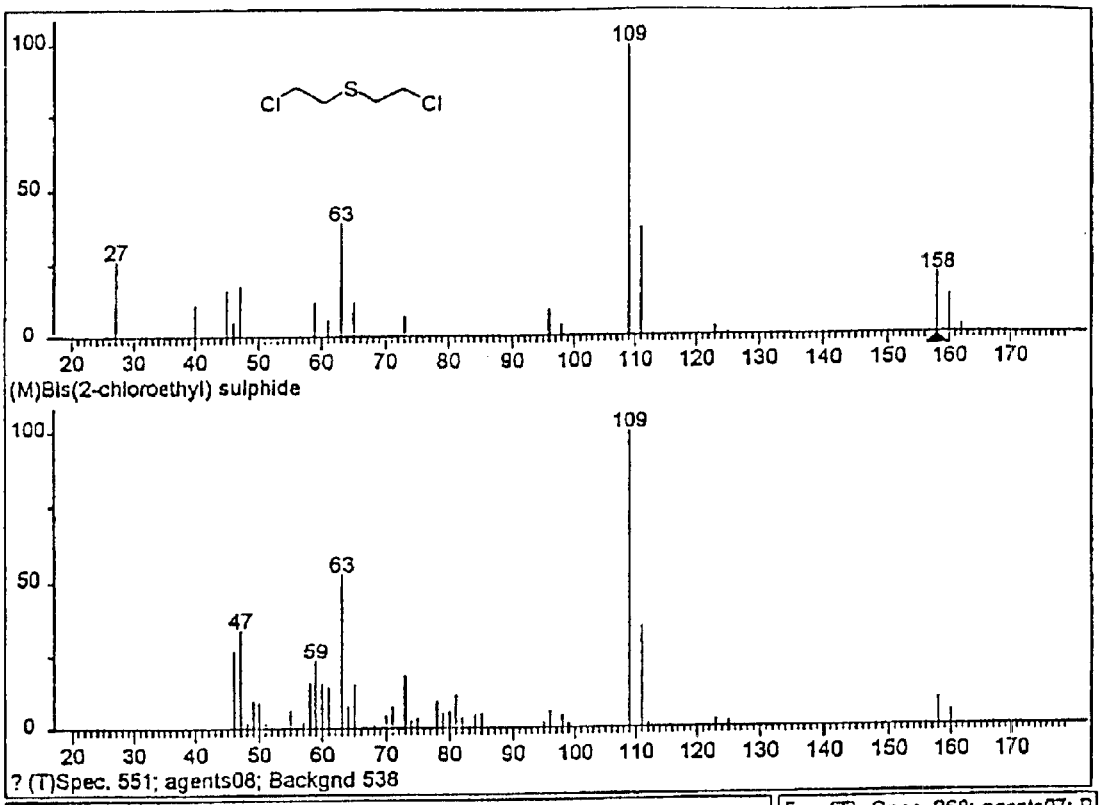

| | | | | |
|---|---|---|---|---|
| 1 | 689 | 849R | 85.7P | (M)Bis(2-chloroethyl) sulphide |
| 2 | 605 | 753R | 11.1P | (M)5-Chloro-2,4-dithiahexane 2,2-dioxide |
| 3 | 520 | 597R | 1.00P | (M)1-Propene, 3,3,3-trichloro- |
| 4 | 496 | 526R | 0.60P | (M)Oxirane, (2,2,2-trichloroethyl)- |
| 5 | 481 | 618R | 0.36P | (M)1,1-Dimethyl-1-silacyclo-2,4-hexadiene |
| 6 | 461 | 491R | 0.22P | (M)(E)-1-Chloro-2-(methylsulfonyl)ethylene |
| 7 | 458 | 514R | 0.17P | (M)(Z)-1-Chloro-2-(methylsulfonyl)ethylene |
| 8 | 453 | 493R | 0.14P | (M)1-Propene, 1,1,2-trichloro- |
| 9 | 450 | 582R | 0.11P | (M)Cyclopropane, 1,1-dichloro-2-(methylthio)- |
| 10 | 449 | 509R | 0.09P | (M)1-Pentene, 1,1,5-trichloro- |
| 11 | 445 | 472R | 0.07P | (M)Phosphonic acid, (2-chloroethyl)- |
| 12 | 444 | 550R | 0.06P | (M)1-Propene, 1,2,3-trichloro- |
| 13 | 443 | 496R | 0.04P | (M)Benzene, (fluoromethyl)- |
| 14 | 430 | 468R | 0.03P | (M)Benzene, 1-fluoro-4-methyl- |

| | |
|---|---|
| 5 | (T) Spec. 268; agents07; B |
| 6 | (T) Spec. 268; agents07; B |
| 7 | (T) Spec. 268; agents07; B |
| 8 | (T) Spec. 268; agents07; B |
| 9 | (T) Spec. 268; agents07; B |
| 10 | ? (T) Spec. 551; agents08; |

*Fig. 3*

Fig. 5

| Agent Under Test | w/w% Agent | w/w% SD | SD/ Agent | Buffer Strength | w/w% Foamer/ Surfactant | w/w% Cosolvent | Time (Min) | % Agent Remaining | | LC-MS Ions Monitored |
|---|---|---|---|---|---|---|---|---|---|---|
| | | | | | | | | LC-FPD | LC-MS | |
| GB | 0.29 | 3.0 | 5.7 | 0.67 | 1.3 | 0 | 0.43 | <0.56 | - | - |
| | | | | | | | 3.7 | - | <0.2 | 99.1, 141.1 |
| | | | | | | | 5.6 | <0.56 | - | - |
| | | | | | | | 10.8 | - | <0.2 | 99.1, 141.1 |
| | | | | | | | 56.6 | <0.56 | - | - |
| GB | 0.29 | 6.0 | 11.4 | 1.0 | 4.6 | 6.9 | 1.13 | <0.56 | - | - |
| | | | | | | | 3.52 | - | <0.2 | 99.1, 141.1 |
| | | | | | | | 4.92 | <0.56 | - | - |
| | | | | | | | 10.0 | - | <0.2 | 99.1, 141.1 |
| GB | 0.29 | 9.0 | 17.2 | 1.0 | 4.8 | 6.9 | 1.78 | <0.56 | - | - |
| | | | | | | | 5.43 | <0.56 | - | - |
| GA | 0.29 | 3.0 | 5.7 | 0.67 | 1.6 | 0 | 1.33 | 0 | - | - |
| | | | | | | | 2.43 | 0 | - | - |
| | | | | | | | 4.95 | 0 | - | - |
| | | | | | | | 53.0 | 0 | - | - |
| | | | | | | | 21.8hrs | 0 | - | - |
| GA | 0.29 | 3.0 | 5.7 | 0.67 | 1.8 | 0 | 1.07 | 0 | - | - |
| | | | | | | | 3.43 | - | <0.46 | 163.1 |
| | | | | | | | 4.85 | 0 | - | - |
| | | | | | | | 9.67 | - | <0.46 | 163.1 |
| GA | 0.29 | 6.0 | 11.4 | 1.0 | 4.5 | 7.5 | 1.07 | 0 | - | - |
| | | | | | | | 3.35 | - | <0.46 | 163.1 |
| | | | | | | | 4.85 | 0 | - | - |
| | | | | | | | 10.0 | - | <0.46 | 163.1 |
| | | | | | | | 360 | 0 | - | - |
| GD | 0.29 | 3.0 | 5.7 | 0.67 | 1.6 | 0 | 1.07 | 5.0 | - | - |
| | | | | | | | 2.17 | tr | - | - |
| | | | | | | | 3.53 | tr | tr | 183.1 |
| | | | | | | | 4.77 | 0.5 | - | - |
| | | | | | | | 10.0 | - | <0.06 | 183.1 |
| GD | 0.29 | 6.0 | 11.4 | 1.0 | 4.6 | 7.8 | 1.08 | 4.3 | - | - |
| | | | | | | | 2.22 | tr | - | - |
| | | | | | | | 3.53 | tr | tr | 183.1 |
| | | | | | | | 4.85 | 1.4 | - | - |
| | | | | | | | 9.98 | - | <0.06 | 183.1 |
| HD | 0.27 | 3.0 | 5.7 | 0.67 | 1.6 | 0.0 | 2.67 | 0.0 | - | - |
| | | | | | | | 4.92 | 0.0 | - | - |
| HD | 0.27 | 3.0 | 5.7 | 0.67 | 1.6 | 0.0 | 3.0 | 0.0 | - | - |
| | | | | | | | 5.4 | 6.2 | - | - |
| | | | | | | | 62.1 | 0.0 | - | - |
| HD | 0.27 | 3.0 | 5.7 | 0.67 | 1.6 | 0.0 | 3.65 | 0.0 | - | - |
| | | | | | | | 4.97 | 0.0 | - | - |
| HD | 0.27 | 6.0 | 11.4 | 1.0 | 4.7 | 7.2 | 2.47 | 0.0 | - | - |
| | | | | | | | 5.27 | 0.0 | - | - |
| | | | | | | | 53.3 | 0.0 | - | - |

*Fig. 6*

| Formulation | uL/mL | VX Molar ratio SD/VX | mg weighed | Reaction Time (minutes) | Residual VX | Product Toxic ? | Notes |
|---|---|---|---|---|---|---|---|
| Buffer/Surfactant | 4 | | | 6 days | 42% | YES | |
| FS* wo/SD | 12 | | | 125 | >50% | YES | VX droplets not solubilizing |
| FS* wo/SD | 12 | | | 6 days | >50% | YES | |
| FS* | 12 | 0.0 | | 24 | 0 | 0 | |
| FS* | 12 | 0.0 | | 7 | 0 | 0 | |
| Mild | 12 | 0.0 | 11.6 | 6 | 24.90% | NO | |
| Mild | 12 | 0.0 | 12.2 | 11 | 20.90% | Trace | |
| Mild | 12 | 0.0 | 12.2 | 15 | 11.40% | Trace | |
| Mild | 12 | 0.0 | 11.7 | 33 | 11.80% | Trace | |
| Mild | 12 | 0.0 | 11.6 | 230 | 19.40% | Trace | |
| Mild | 12 | 0.0 | 11.6 | 3 days 23 hrs | 50.10% | Trace | |
| Mild | 12 | 6.3 | 11.6 | 5 days | 28.77% | | |
| Mild | 4 | 0.0 | 4.3 | 7 | 1.28% | Trace | |
| Mild | 4 | 0.0 | 4 | 11 | 0.63% | Trace | |
| Mild | 4 | 0.0 | 4 | 66 | 0.65% | Trace | |
| Mild | 4 | 0.0 | 4 | 189 | 0.56% | Trace | |
| Mild | 3 | 0.0 | 2.5 | 12 | 0.68% | Trace | |
| Mild | 0 | 0 | 0 | - | 0 | - | |

* Full 9% SD Strength

*Fig. 7*

| | Test | % DFP (w/w) | % SD (w/w) | % LiOCl (w/w) | % Foamer (w/w) | % Cosolvent (w/w) | Time (Min) | % DFP Residual | % DFP at 30 min. |
|---|---|---|---|---|---|---|---|---|---|
| SD | 7-115 | 1.24 | 0 | 0 | 0 | 0 | 0.00 | 100 | 87 |
| | | | | | | | 6.25 | 107 | |
| | | | | | | | 11.58 | 112 | |
| | | | | | | | 18.60 | 96 | |
| | | | | | | | 31.25 | 85 | |
| | | | | | | | 66.00 | 80 | |
| | | | | | | | 106.77 | 68 | |
| | 7-97 | 1.25 | 7.33 | 0 | 0 | 0 | 0.00 | 100 | 3 |
| | | | | | | | 5.67 | 23 | |
| | | | | | | | 10.05 | 10 | |
| | | | | | | | 15.17 | 6 | |
| | | | | | | | 25.05 | 0 | |
| | 7-123 | 1.34 | 7.97 | 0 | 0 | 7.2 | 0.00 | 100 | 25 |
| | | | | | | | 5.17 | 40 | |
| | | | | | | | 10.30 | 39 | |
| | | | | | | | 15.05 | 36 | |
| | | | | | | | 28.72 | 24 | |
| | | | | | | | 59.85 | 14 | |
| | | | | | | | 113.83 | 9 | |
| | 7-137 | 1.25 | 7.42 | 0 | 3.5 | 7.6 | 0.00 | 100 | 21 |
| | | | | | | | 5.13 | 59 | |
| | | | | | | | 10.05 | 46 | |
| | | | | | | | 15.10 | 36 | |
| | | | | | | | 30.43 | 22 | |
| | | | | | | | 60.00 | 13 | |
| SD+KBr | 7-143 | 0.26 | 13.72 | 0 | 3.4 | 6.3 | 0.00 | 100 | 23 |
| | | | | | | | 5.30 | 61 | |
| | | | | | | | 9.88 | 43 | |
| | | | | | | | 14.75 | 32 | |
| | | | | | | | 29.82 | 23 | |
| | | | | | | | 60.02 | 16 | |
| | | | | | | | 118.00 | 11 | |
| | 7-147 | 0.36 | 15 | 0 | 3.5 | 8.5 | 0.00 | 100 | 8 |
| | | | | | | | 5.27 | 12 | |
| | | | | | | | 10.07 | 26 | |
| | | | | | | | 15.63 | 20 | |
| | | | | | | | 30.43 | 8 | |
| | | | | | | | 59.67 | 6 | |
| SD + LiOCl | 8-21 | 0.29 | 11.32 | 0 | 1.5 | 0 | 0.00 | 100 | 2 |
| | | | | | | | 4.98 | 40 | 2 |
| | | | | | | | 10.00 | 20 | |
| | | | | | | | 15.08 | 10 | |
| | | | | | | | 30.00 | 2 | |
| | | | | | | | 60.38 | 0 | |
| | | | | | | | 120.00 | 0 | |
| | 8-23 | 0.32 | 6.52 | 0.19 | 1.5 | 0 | 0.00 | 100 | 0.5 |
| | | | | | | | 4.88 | 17 | |
| | | | | | | | 10.05 | 6 | |
| | | | | | | | 15.03 | 3 | |
| | | | | | | | 30.00 | 1 | |
| | | | | | | | 60.00 | 0 | |
| | | | | | | | 120.00 | 0 | |

Fig. 12

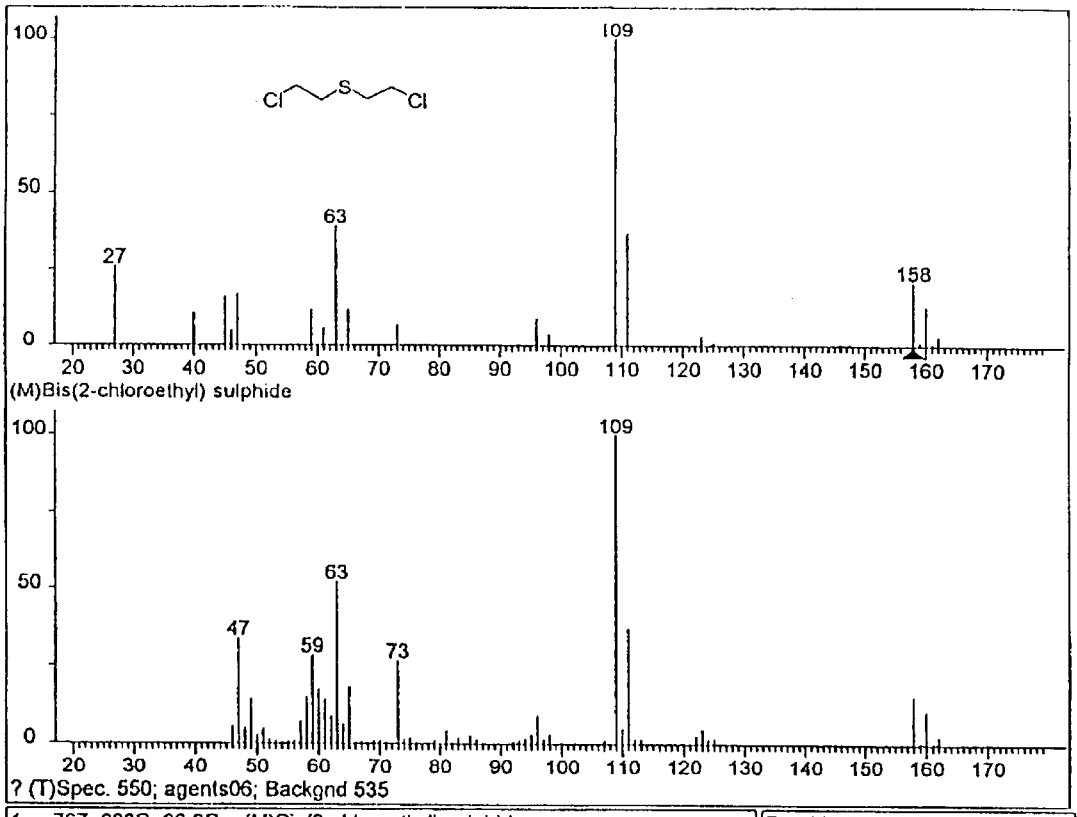

| | | | | |
|---|---|---|---|---|
| 1 | 767 | 923R | 96.3P | (M)Bis(2-chloroethyl) sulphide |
| 2 | 553 | 590R | 0.96P | (M)Butane, 1,2,3,4-tetrachloro- |
| 3 | 540 | 604R | 0.77P | (M)1-Propene, 3,3,3-trichloro- |
| 4 | 522 | 576R | 0.47P | (M)p-Fluoroethylbenzene |
| 5 | 505 | 693R | 0.28P | (M)5-Chloro-2,4-dithiahexane 2,2-dioxide |
| 6 | 500 | 556R | 0.22P | (M)1-Pentene, 1,1,5-trichloro- |
| 7 | 496 | 499R | 0.18P | (M)Butane, 1,2,2,4-tetrachloro- |
| 8 | 492 | 750R | 0.14P | (M)1-Propene, 1,1,3-trichloro- |
| 9 | 491 | 562R | 0.12P | (M)Benzene, 1-fluoro-4-methyl- |
| 10 | 485 | 563R | 0.09P | (M)Benzene, (fluoromethyl)- |
| 11 | 484 | 598R | 0.07P | (M)1-Propene, 1,2,3-trichloro- |
| 12 | 474 | 578R | 0.06P | (M)Benzene, 1-fluoro-3-methyl- |
| 13 | 471 | 589R | 0.05P | (M)Benzene, 1-fluoro-2-methyl- |
| 14 | 466 | 609R | 0.04P | (M)1,1-Dimethyl-1-silacyclo-2,4-hexadiene |
| 15 | 452 | 496R | 0.03P | (M)5-Octyn-4-one, 2,2,7,7-tetramethyl- |

| | |
|---|---|
| 7 | (T) Spec. 580; NIST hit #1; |
| 8 | (T) Spec. 22; survey06; Ba |
| 9 | (T) Spec. 55; survey06; Ba |
| 10 | (T) Spec. 313; agents02; B |
| 11 | (T) Spec. 106; agents04; B |
| 12 | ? (T) Spec. 550; agents06; |

A
B
C
D
E
E
LEGEND
Total CADS Response
Event Marker
12.0
8.0
4.0
0.0
0.0
5.0
10.0
15.0
TIME (MIN)
SUM OF AVERAGED CADS RESPONSES (BARS)

BROAD SPECTRUM DECONTAMINATION FORMULATION AND METHOD OF USE

This application claims the benefit of U.S. Provisional Application No. 60/120,971, filed Feb. 19, 1999, the entire content of which is hereby incorporated by reference in this application.

FIELD OF THE INVENTION

The present invention relates to decontamination formulations and more particularly to formulations for decontaminating surfaces and/or materials contaminated with chemical and/or biological warfare agents and/or nuclear radioactive particles.

BACKGROUND OF THE INVENTION

Chemical (CW) and biological (BW) warfare agents (collectively CB agents) are becoming an increasingly important part of defence weaponry. Further, radioactive fallout or dusts have also been of concern, since nuclear devices have been added to military arsenals.

Nuclear/Radioactive Particles

Nuclear or radioactive particles pose a significant threat to personnel due to the effects of ionizing radiation. In addition to the initial release of radiation from a nuclear device and radiation caused by emission from materials which have become radioactive as a result of the initial detonation, inhalation of radioactive dusts or particulate matter can lead to significant numbers of casualties long after the attack. As with BW agents, secondary aerosolization poses an ever-present threat and results in the need to wear protective masks for extended periods of time.

Biological Warfare (BW) Agents

BW agents are characterized as microorganisms including bacteria, viruses and fungi. They are particulate in nature and present a significant hazard long after an attack through formation of secondary aerosols which are inhaled. Unlike CW, BW agents may not result in immediate effects. A lapse of hours, days or weeks may occur before the full extent of their effects become apparent. In the case of certain BW agents, like anthrax, spore production ensures that the BW agent can remain in the environment for years while retaining biological activity. While BW agents may be readily removed from a surface they are often merely repositioned in the underlying environment and remain hazardous if disturbed.

Chemical Warfare (CW) Agents

Three main types of persistent and semi-persistent CW agents exist. They are vesicants and two families of nerve gases, V and G, as outlined in Table I.

TABLE I

| Family | Agent | Acronym | Formula |
|---|---|---|---|
| Vesicants | Sulfur Mustard | HD | $Cl\ CH_2CH_2S\ CH_2CH_2Cl$ |
| | Nitrogen Mustard | HN-1 | $(CH_2CH_2Cl)_2NC_2H_5$ |
| | Nitrogen Mustard | HN-2 | $(CH_2CH_2Cl)_2NCH_3$ |
| | Nitrogen Mustard | HN-3 | $N(CH_2CH_2Cl)_3$ |
| | Lewisite | L | $ClCH{=}CHAsCl_2$ |
| G | Tabun | GA | $C_5H_{11}N_2O_2P$ |
| | Sarin | GB | $C_4H_{10}FO_2P$ |
| | Soman | GD | $C_7H_{16}FO_2P$ |
| V | | VX | $CH_3CH_2O{-}P(O)(CH_3){-}SCH_2CH_2N(C_3H_7)_2$ |

Vesicants act as blistering agents that attack skin and mucous membranes and are lethal at high doses.

The V agents are in the phosphorylthiocholine class of compounds, while the G agents are phosphonofluoridates.

Both share the same reaction chemistry as organophosphorous esters and pesticides. Nerve agents act on the central nervous system by reacting with the enzyme acetylcholinesterase to cause respiratory collapse, convulsions and death.

G-agents tend to be semi-volatile and toxic by inhalation and percutaneous absorption, while V-agents are relatively non-volatile, persistent, and very toxic by the percutaneous route.

The threat of the use of CB agents and nuclear devices has prompted the need to develop protective and decontamination measures for personnel and military hardware.

Decontamination—Radioactive Particles

As radioactive particles are nuclear in origin, decontamination cannot deactivate the radioactive hazard. However, the removal of the particulate matter from equipment can significantly reduce aerosolization potential and the spread of the radioactive hazard to clean areas. Generally, removal of the particulate matter requires the encapsulation of the particles and subsequent removal of the encapsulated material from equipment surfaces.

Decontamination—BW Agents

In the case of BW agents, personal protective equipment such as masks, protective suits etc. are the primary defence against contamination. In some cases, where time and environmental conditions exist, natural weathering such as exposure to sunshine, heat and moisture may destroy the BW agent.

For many BW agents, standard disinfectants can be very effective as decontaminants. An example is the use of hypochlorites or chlorine gas in the treatment of water supplies, swimming pools and in sanitizing food preparation equipment. Active chlorine is considered to be among the most economical yet most effective broad spectrum BW agent decontaminant. Hypochlorites have been shown to be effective against some of the most robust BW agents such as anthrax spores as well as viruses and bacteria. Hypochlorous acid is superior to that of hypochlorite anion as it more readily crosses the cell membrane. Thus, it would be advantageous to perform decontamination of BW agents in a slightly acidic, neutral or slightly basic media where hypochlorous acid is a dominant active component rather than in a strongly basic solution, where hypochlorite anion is the predominant species.

Decontamination—CW Agents

CW agent decontamination presents a number of challenges. Following a CW agent attack, the semi-persistent or persistent nature of these agents allows them to remain toxic, not only during dissemination, but also for many hours or even days after the attack. The principal hazard occurs through direct inhalation of the vapor off-gassed from the agent or through physical contact with the skin or mucous membranes, through which it is absorbed.

Generally

Ideally, a decontamination formulation should be broad-spectrum in nature, as in most cases the actual nature of the warfare agents being faced is not known. It should be compatible with, and non-corrosive to, equipment used in its application as well as to the equipment to be decontaminated. It should not soften nor damage paints, coatings, polymeric seals or gaskets or transparencies such as windscreens. It should not interfere with in-service monitoring equipment used to verify the effectiveness of the decontamination or to locate residual contamination. It should be easy to prepare, easy to apply and remove, and remain stable for reasonable lengths of time after preparation. It is highly desirable that it adhere to and coat vertical surfaces for sufficient periods of time for agent desorption from the surface and detoxification, yet be easy to remove by evaporation or by rinsing. If used in combination with a surfactant, the decontamination formulation should not compromise the integrity of the foam. It should be of low toxicity, be non-flammable and have a low impact on the environment in order that training can be realistically and frequently performed. Preferably, the formulation should be based in media capable of solubilizing and supporting detoxification of the sparingly soluble CW agents and solubilizing and degrading polymeric thickeners in which the CW agent may reside. Often, these thickeners have high adherence to surfaces and are more difficult to remove than the agents in neat form. Where possible, the decontaminant should be in a concentrated form for mixing with water or other suitable diluent in order to reduce logistical loads on transport and storage and should be readily mixed. For economic reasons it should be formulated from compounds that are readily available in large quantities and be stable in storage for long periods of time. Ideally, the media for dilution should be water or seawater as, in most cases, it is readily available on site and is non-toxic.

Prior art decontamination formulations have taken advantage of the fact that CW agents can generally be oxidized or hydrolyzed, dependent upon their structure, to result in non-toxic products. Many BW agents are readily decontaminated by those same active ingredients, such as hypochlorite and radioactive particles are encapsulated by the surfactants utilized to cause the formulations to adhere to vertical surfaces and are removed and diluted during the removal of the formulation, generally by washing.

In the case of V agents, mustards and biological warfare agents, oxidation has been most successful. Various reactants such as hypochlorites, permanganates, N-chloro and N-bromo compounds, ozonizing compounds and peroxides have been used.

G-agents are not easily oxidized, therefore hydrolysis is normally utilized to address this family of agents. Although hydrolysis can be effective with mustards, they must be in solution before they can be hydrolyzed. Hydrolysis can be accomplished using hydroxides or hypochlorites acting as catalyst, and by water, often with the addition of metal salts to catalyze the reaction. Hydrolysis utilizing enzymes such as organophosphorus acid anhydrase has been studied, although large scale broad spectrum decontaminants are not yet available using this approach.

Nucleophilic displacement can be used to decontaminate nerve and vesicant agents. Since it involves replacement of one group with another less active one, the processes of oxidation and hydrolysis are not necessarily employed. In order to be effective, a formulation utilizing nucleophilic displacement must provide stoichiometric replacement species for all of the CW agents it may encounter, thus adding to the logistical load of transport and storage.

Among the first decontaminants to be used was bleach powder and, to a much lesser degree, potassium permanganate. Bleach can convert CW agents into inert products at the liquid (Bleach solution) or liquid-solid (bleach powder) interface within a few minutes via vigorous oxidation and elimination reactions. However, there are disadvantages. The active chlorine content in bleach decreases gradually with storage time, hence an excess amount of bleach is needed for the oxidation of some agents. In addition, its alkalinity can be corrosive to metal surfaces. Its effectiveness is limited to removing agents from surfaces, since it is not effective in removing agents that have already penetrated into paints.

Following the use of bleach as a decontaminant, the US Army introduced Decontamination Solution 2 (DS2), which is a wide-spectrum, ready-to-use, chemically reactive nucleophilic decontaminant, having long-term stability over an extended range of temperature of −26° C. to 52° C. This polar non-aqueous liquid consists, by weight, of 70% diethylenetriamine, 28% ethylene glycol monomethyl ether and 2% sodium hydroxide. At ambient temperature, it reacts with any of the HD, VX, GA or GB agents within a few seconds. Typically, DS2 is premixed and stored in 1.3 qt cans, 5-gallon pails and 14-L containers.

However, DS2 does have drawbacks. It is a highly aggressive chemical solution that is toxic and flammable. It damages paint, plastics, rubber and leather materials and, in use, leads to rapid corrosion and oxidation of some metals. It must be used in its premixed form, which poses a logistical transport problem. DS2 is corrosive to the skin, requiring personnel handling it to wear respirators with eye shields and chemically protective gloves to avoid skin contact. Ethylene glycol monomethyl ether has been identified as being toxic to personnel.

Another popular decontaminant is the German Emulsion (C8) system. This system consists, by weight, of 76% water, 15% perchloroethylene, 1% anionic surfactant and 8% high-test-hypochlorite (HTH). Many of the benefits of this system are attributed to the perchloroethylene continuous phase. C8 is of low corrosivity despite the high pH of the aqueous phase. It is effective in dissolving thickeners and can penetrate paint and react with the embedded agents, without damaging the paint. It is viscous enough to provide a thin and coherent film on the surface to allow sufficient time for reaction with the agents.

C8 has several drawbacks. It must be mixed for periods of up to an hour prior to use to generate the emulsion. Even then, it is possible that no emulsion will form. Perchloroethylene has recently been identified by the Canadian and other governments as being environmentally unacceptable and its production and use has been discouraged. The eventual goal is to completely phase out its production. Removal of the perchloroethylene from the decontaminant would render it incapable of solubilizing thickened agents and dissolving highly insoluble CW agents. The surfactant designed to form the emulsion is difficult to obtain. It was originally only available from a manufacturer in West Germany, which has recently discontinued its production.

Clearly, given the drawbacks of the existing decontamination formulations, it is necessary to develop a formulation that is stable, non-toxic to personnel and to the environment, of low corrosivity, effective against a broad spectrum of CW agents, BW agents, and, optionally, radioactive particulate matter, prepared on site in a substantially aqueous medium and capable of coating surfaces, including vertical surfaces, for a minimum of 30 minutes as outlined by NATO.

It is clear that the effectiveness of any formulation does not rely solely on the active ingredient, but rather with its overall composition.

SUMMARY OF THE INVENTION

A decontamination formulation is provided which is effective against a broad spectrum of chemical and biological warfare agents, including those with persistent spore production. Further, it is capable of encapsulating particulate radioactive material for facilitating efficient removal by scrubbing and/or rinsing.

In a simplified aspect of the present invention, the decontamination formulation comprises a synergistic combination of an active decontamination agent, a co-solvent preferably undetectable by decontamination monitoring equipment which aids in solubilization of relatively insoluble chemical warfare agents and thickened agents, a buffer system to optimize the initial reaction pH above 8.5 and more preferably in the range of 10 to 11 for favoring oxidation of VX and HD and hydrolysis of G agents, and finally a surfactant to aid in encapsulation of particulate matter and formation of a reliable foam of uniform bubble size when aerated. The surfactant enables foaming of the formulation for coating of surfaces including adherence to vertical surfaces. This coating is stable for sufficient time to ensure effective contact and decontamination. The formulation of the present invention is soluble in an aqueous medium and the use of gray or seawater does not significantly affect its activity.

By varying the concentration of active ingredients within the formulation, a family of formulations result which are capable of responding to different hazardous situations. For rapid decontamination of surfaces, thin layers of foam may be sufficient, but strong active ingredient formulations are required. On the other hand, thick, uniform bubble size foam is an effective blast suppressant. High contamination is best handled with strong active ingredient formulations but the foam's structure, an important property for blast suppression, can be somewhat compromised by high amounts of added ingredients, such as decontaminants. At reduced amounts of active decontaminant, the foam's structure remains unaltered, allowing it to be used for blast suppression, yet retain decontamination abilities. Further, reducing active decontaminant and buffer strength may also result in decreased corrosivity.

Accordingly, in a broad aspect of the present invention, there is provided a family of decontaminant formulations comprising:

from about 1% to about 15% by weight and preferably from about 3% to about 9% by weight of a hydrated chloroisocyanuric acid;

from about 1% to about 10% and preferably from about 8% to about 10% by volume of a co-solvent selected from the group consisting of polypropylene glycols, polyethylene glycols, and derivatives and mixtures thereof;

from about 1% to about 15% and preferably from about 1% to about 10% by volume of a surfactant;

a buffer system to initially maintain said formulation at a pH from about 8.5 to about 11 for a minimum of 30 minutes and preferably initially, from about 10 to about 11; and the balance being water.

Preferably, the chloroisocyanuric acid is selected from the group consisting of an alkali metal of monochloroisocyanuric acid and dichloroisocyanuric acid such as sodium dichloroisocyanurate, trichloroisocyanuric acid and a combination thereof with cyanuric acid. The formulation may additionally comprise lithium hypochlorite to enhance the activity of the dichloroisocyanuric acid salt.

In one preferred embodiment of the invention, the polypropylene glycol has the chemical formula $R^1$—$(OCH(CH_3)CH_2)_n$—$OR^2$, where $R^1$ and $R^2$ are independently H, an alkyl, or an ester group and n>1 or alternately, a partially etherified polypropylene glycol where one of $R^1$ and $R^2$ is independently H, or an alkyl group and n>1. In both cases the alkyl group may consist of a methyl, ethyl, propyl, butyl or a mixture thereof. Use of certain higher molecular weight co-solvents avoids subsequent false positive detection of the co-solvent as residual contaminant by some monitoring equipment.

Preferably, the buffer system forming the decontamination formulation is a dual component inorganic buffer mixture of sodium tetraborate decahydrate and anhydrous sodium carbonate adjusted to an initial pH of from about 10 to about 11 using sodium hydroxide or, optionally, sodium metasilicate pentahydrate.

One suitable surfactant consists of a composition of the formula $[R(OCH_2CH_2)_nX]_aM_b$, where R is an alkyl group having from eight to eighteen carbon atoms; n is an integer from 0 to 10; X is selected from the group of $SO_3^{2-}$, $SO_4^{2-}$, $CO_3^{2-}$ and $PO_4^{3-}$, M is an alkali metal, alkaline earth metal, ammonium or amine derivative; a is the valence of M and b is the valence of $[R(OCH_2CH_2)_nX]$ or a mixture thereof.

Preferably, the surfactant consists of a composition of the formula $[R—CH{=}CH(CH_2)_m-X]_aM_b$ where R is an alkyl group having from eight to eighteen carbon atoms; m is an integer from 0 to 3; X is selected from the group of $SO_3^{2-}$, $SO_4^{2-}$, $CO_3^{2-}$ and $PO_4^{3-}$, M is an alkali metal, alkaline earth metal, ammonium or amine derivative; a is the valence of M and b is the valence of $[R—CH{=}CH(CH_2)_m—X]$ or a mixture thereof.

Preferably, the surfactant also consists of a composition of the formulae R—OH, where R is an alkyl group having from eight to sixteen carbon atoms or mixtures thereof.

Preferably, the surfactant also consists of polypropylene glycol having the chemical formula $R^1$—$(OCH(CH_3)CH_2)_n$—$OR^2$, where $R^1$ and $R^2$ are independently H, an alkyl, or an ester group and n>1 or alternately, a partially etherified polypropylene glycol where one of $R^1$ or $R^2$ is independently H, or an alkyl group and n>1.

In another broad aspect of the present invention there is provided a method of preparing and delivering a decontamination formulation comprising the steps of:

preparing a first aqueous solution comprising about 30% by weight of chloroisocyanuric acid salt or the equivalent active chlorine content of a mixture of chloroisocyanuric salt and lithium hypochlorite;

preparing a second aqueous solution comprising a mixture of sodium tetraborate decahydrate, anhydrous sodium carbonate, adjusted to a pH of from about 10 to about 11;

providing a co-solvent selected from the group consisting of polypropylene glycol, polyethylene glycol and a derivative and mixture thereof;

providing a surfactant comprising a composition of the formulae $[R(OCH_2CH_2)_nX]_aM_b$, where R is an alkyl group having from eight to eighteen carbon atoms; n is an integer from 0 to 10; X is selected from the group of $SO_3^{2-}$, $SO_4^{2-}$, $CO_3^{2-}$ and $PO_4^{3-}$, M is an alkali metal, alkaline earth metal, ammonium or amine derivative; a is the valence of M and b is the valence of $[R(OCH_2CH_2)_nX]$ or a mixture thereof;

preferably, a composition of the formula $[R—CH{=}CH(CH_2)_m—X]_aM_b$ where R is an alkyl group having from eight to eighteen carbon atoms; m is an integer from 0 to 3; X is selected from the group of $SO_3^{2-}$, $SO_4^{2-}$, $CO_3^{2-}$ and $PO_4^{3-}$, M is an alkali metal, alkaline earth metal, ammonium or amine derivatives; a is the valence of M and b is the valence of $[R—CH{=}CH(CH_2)_m—X]$ or a mixture thereof;

preferably, the surfactant also consists of a composition of the formulae R—OH, where R is an alkyl group having from eight to sixteen carbon atoms or mixtures thereof;

preferably, the surfactant also consists of polypropylene glycol having the chemical formula $R^1$—$(OCH(CH_3)CH_2)_n$—$OR^2$, where $R^1$ and $R^2$ are independently H, an alkyl, or an ester group and n>1 or alternately, a partially etherified polypropylene glycol where one of $R^1$ or $R^2$ is independently H, or an alkyl group and n>1;

providing source water; and pumping the formulation through an aeration nozzle to create a decontamination foam.

In a preferred aspect of the present invention, the co-solvent and surfactant are mixed together and pumped with the source water through a pumping device. The first and second aqueous solutions are introduced into the stream between the pump and the aeration nozzle for delivery as a foam. Addition of the more erosive and corrosive active decontaminant and buffer to the stream after the pump is advantageous as it prolongs pump life.

Alternatively, all of the ingredients may be premixed with source water and pumped simultaneously through the pumping device and the aeration nozzle, or may be introduced to the source water stream individually.

BRIEF DESCRIPTION OF THE DRAWINGS

FIG. 3 is a complete mass spectrum of the library mustard spectrum m/z 109 peak in the middle trace of FIG. 1;

FIG. 5 is a table of results demonstrating decontamination of GA, GB, GD and HD agents according, to Example 3;

FIG. 6 is a table of results demonstrating decontamination of VX agents according to Example 4;

FIG. 7 is a table of results demonstrating neutralization of a CW agent simulant DFP according to Example 5;

FIGS. 11–14 are graphs demonstrating the decontamination of mustard from of a vehicle according to Example 7, specifically gas chromatograph (GC)-mass spectral (MS) analysis of samples before decontamination, an MS library spectrum trace, the library search values, GC/MS analysis of samples 10 minutes after decontamination, and semi-quantitative and chronological results from 8 chemical agent real-time monitoring stations deployed around the vehicle;

DETAILED DESCRIPTION OF THE PREFERRED EMBODIMENT

Figure 1B:
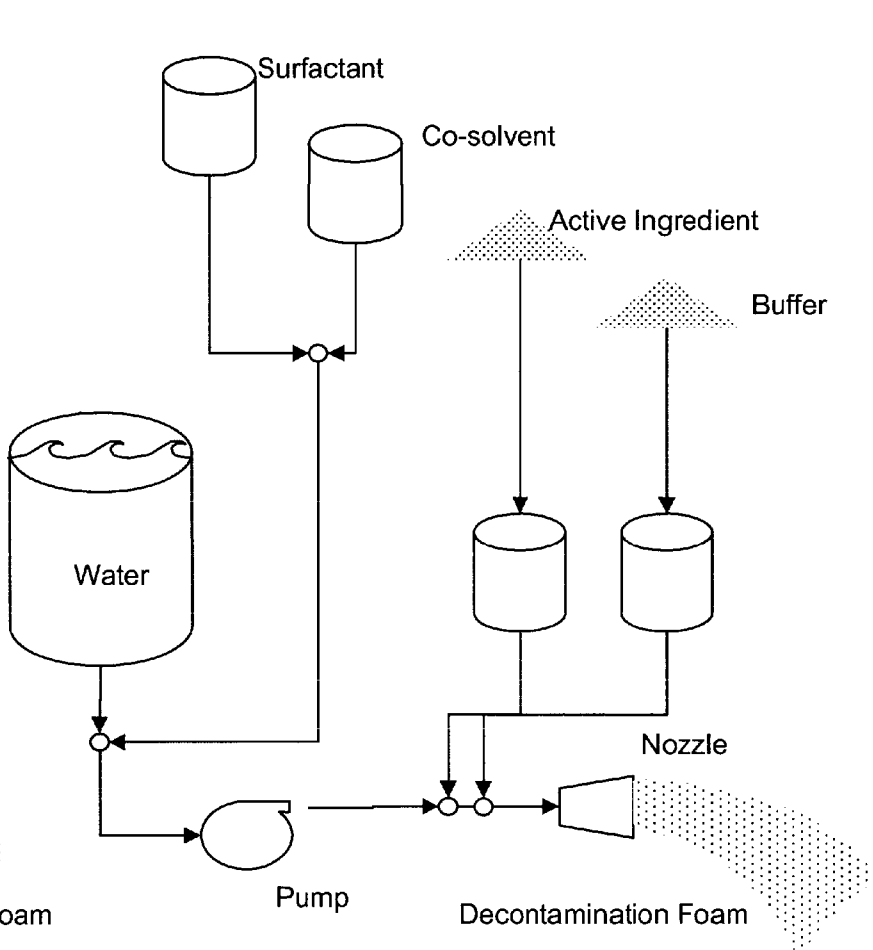
FIGS. 1*a* and 1*b* are schematic representations of a pre-mix and a staged mixing embodiment of the method of application of the decontamination formulation.

In the present invention, a decontamination formulation and means for use are provided which incorporates the known active ingredient, hypochlorite, in a uniquely buffered solution designed to be incorporated into a foam for maximal and stable coating, including vertical surfaces, for a prolonged period including NATO prescribed periods of 30 minutes.

Active Ingredient

The formulation contains as an active ingredient, sodium dichloroisocyanurate. Other chloroisocyanuric acids, their alkali metal salts or a combination of acids including trichloroisocyanuric acid are also suitable for use as the active ingredient. As an example, alkali metal salts of monochloroisocyanuric or dichloroisocyanuric acid or a combination of any of the above salts with cyanuric acid may be used.

The formulation of the present invention contains from about 1% to about 15%, and preferably from about 3% to about 9%, by weight, of the hydrated dichloroisocyanuric acid salt. The formulation may additionally comprise lithium hypochlorite to enhance the activity of the dichloroisocyanuric acid salt.

Co-Solvent

The formulation further comprises a co-solvent consisting of from about 1% to about 10% and preferably 8% to about 10% by volume, of propylene glycol, polyethylene glycol, or derivatives or mixtures thereof. The glycol co-solvent improves the solubilization of the CW agents, particularly the relatively water-insoluble mustards, and thickeners, in otherwise aqueous solutions. Typically, efficient solubilization is obtained in the range from about 8% upwards, whereas lower amounts will provide some solubilization properties to the formulation.

In one preferred embodiment of the invention, the polypropylene glycol has the chemical formula $R^1$—$(OCH(CH_3)CH_2)_n$—$OR^2$ where $R^1$ and $R^2$ are independently H, an alkyl, or an ester group and n>1. The alkyl group may consist of a methyl, ethyl, propyl, butyl or a mixture thereof. In one example, both $R^1$ and $R^2$ are hydrogens. Alternatively, the polypropylene glycol is a partially etherified polypropylene glycol derivative having the same formula $R^1$—$(OCH(CH_3)CH_2)_n$—$OR^2$, but where only one of $R^1$ or $R^2$ is independently H, or an alkyl group and n>1. Again the alkyl group representing $R^1$ or $R^2$ may be a methyl, ethyl, propyl, butyl group or a mixture thereof. Use of certain higher molecular weight co-solvents avoids subsequent false positive detection of the co-solvent as residual contaminant.

Surfactant

The formulation further comprises from about 1% to about 15% and preferably from about 1.5% to about 10%, by volume, of a surfactant. The surfactant is soluable in an aqueous medium and, when aerated, creates a foam. The amount of surfactant used varies with the amount of co-solvent, active ingredient and buffer present. In the presence of optimum levels of co-solvent, the preferred amount of surfactant is from about 6% to about 10%, by volume. On the other hand, when no co-solvent is added and relatively low amounts of active ingredient are present, the preferred amount of surfactant can be as low as 1.5% by volume. The surfactant wets the surfaces to be decontaminated and creates foam on dispensing, suitable for covering and adhering to vertical surfaces. In the case of radioactive dusts, the surfactant encapsulates the dusts for removal from the subject surface.

Briefly, the surfactant consists of a composition of either the formula $[R(OCH_2CH_2)_nX]_aM_b$, where R is an alkyl group having from eight to eighteen carbon atoms, n is an integer from 1 to 10; X is selected from the group of $SO_3^{2-}$, $SO_4^{2-}$, $CO_3^{2-}$ and $PO_4^{3-}$: M is an alkali metal, alkali earth metal, ammonium or amine derivative; a is the valence of M and b is the valence of $[R(OCH_2CH_2)_nX]$ or more preferably, the formula $[R—CH{=}CH(CH_2)_m—X]_aM_b$ where R is an alkyl group having from eight to eighteen carbon atoms; m is an integer from 0 to 3; X is selected from the group of $SO_3^{2-}$, $SO_4^{2-}$, $CO_3^{2-}$ and $PO_4^{3-}$, M is an alkali metal, alkaline earth metal, ammonium or amine derivative, a is the valence of M and b is the valence of [R—CH═CH $(CH_2)_m$—X] or a mixture thereof and an alkyl alcohol, R—OH, where R is an alkyl group having from eight to sixteen carbons. One such suitable surfactant is Silv-Ex™ made by Ansul Fire Protection described in U.S. Pat. No. 4,770,794 issued to Cundasawmy et al. Sep. 13, 1988. More specifically, the Silv-Ex surfactant consists of 20% by weight of $C_{10}H_{21}(OCH_2CH_2)_{2-3}SO_4^-Na^+$, 20% by weight of $C_{14}H_{29}(OCH_2CH_2)_3SO_4^-NH4^+$, 5% by weight of $C_{12}H_{25}OH$, 20% by weight of diethylene glycol monobutyl ether, 0.5% of corrosion inhibitors and 34.5% by weight of water.

Alternatively, surfactants which do not contain diethylene glycol monobutyl ether are preferable as residuals, as this low molecular weight constituent can be detected by some conventional decontamination monitoring equipment (such as Graseby Ionics™ Chemical Agent Monitor or CAM) and are thus interpreted falsely as positive detection of residual contaminant.

A suitable surfactant consists of a composition of alkyl ether sulphate salt, an alkyl alcohol, an alpha olefin sulfonate, a co-solvent and water. More specifically the surfactant is a composition having the component formulas of $[R_nH_{2n+1}(OCH_2CH_2)_mSO_4^{2-}M]$, where R is an alkyl group having from eight to fourteen carbon atoms, m is an integer from 2 to 3, and M is Na+ or $NH_4^+$, in mixture with R—OH where R=$C_{10}$–$C_{14}$, in mixture with $CH_3(CH_2)_n$ CH═$CHCH_2SO_3Na$, in mixture with $HO(CH_2(CH_3)CHO)_n$ H (polypropylene glycol of MW about 425) where n=5–49 and most preferably 7. The components are in water. In addition, corrosion inhibitors can be added in very small quantities.

Accordingly, a preferred composition of a suitable non-residual surfactant (or NR-surfactant) consists of 30% weight/volume i.e., 300 g/L of all ingredients except water, of the sodium salt of an ether sulphate of the formula $CH_3(CH_2)_{11}(OCH_2CH_2)_3OSO_3Na$; 15.5% weight/volume of a sodium olefin sulphonate of the formula $CH_3(CH_2)_n$ CH═$CHCH_2SO_3Na$ where n=10 to 12; 50% weight/volume of polypropylene glycol solvent of the formula H(OCH $(CH_3)CH_2)_nOH$ where n=5 to 9; 2% weight/volume of an alcohol $CH_3(CH_2)_nOH$ where n=8 to 16; about 0.3% by weight of corrosion inhibitors such as sodium tolyltriazole, ammonium dimolybdate and sodium pentahydrate silicate and the balance being water, with additional water being added to dissolve other components. Further, this NR-surfactant is capable of generating foam of uniform bubble size, is capable of coating vertical surfaces, is compatible with water, gray water and seawater as the main solvent, and is readily removed following decontamination by rinsing with water.

To lower the thixotropic gelling point of the surfactant, useful in a wider range of environments, it has been found that the alcohol component preferably comprises more $C_{12}$ than $C_{14}$ (i.e. n=11). It has been found that diluting the surfactant 1:1 with water for storage and transport further lowers the gelling point.

Alternatively, a combination of surfactants can be used for the preparation of the decontamination formulation. For example, Silv-Ex may be combined with the NR-surfactant, or an alternative formulation or a combination of them with other surfactant ingredients such as sodium laureth sulfate, having the formula $CH_3(CH_2)_{10}CH_2(OCH_2CH_2)_3OSO_3Na$, sodium C14–16 alpha olefin sulfonate having the formula RCH═$CHCH_2$—$SO_3Na$, and ammonium alcohol ethoxysulfate having the formula $C_{8-10}H_{17-21}(OCH_2CH_2)_{2.3}$ $OSO_3^-NH_4^+$.

Buffer

The decontamination formulation of the present invention further comprises a buffer that temporarily maintains an initial pH in the range of 10 to 11, sufficient to enable hydrolysis of G-agents and mustards and favor oxidation of the V-agents so as to produce non-toxic products. An initial pH in the range of 10 to 11 is sufficient to provide adequate hypochlorite ions for decontamination. Subsequently, it is desirable that the buffer fail, allowing the pH to decrease eventually to a more neutral pH to enable more efficient destruction of the BW agents.

As the buffer fails and the pH drops to a more neutral pH, hypochlorous acid becomes more prevalent as hypochlorite ions react with available hydrogen ions. Hypochlorous acid is the more active species with respect to the destruction of BW agents as neutral species are able to enter the cell more easily. Should BW agent survive the initial decontamination, the BW agent and decontamination formulation may continue to co-reside over time, perhaps after rinsing, and, as the pH falls, BW agent decontamination continues at an even more effective pH. Further, from an environmental standpoint, a more neutral final pH of the decontamination formulation is less hazardous.

It is important to maintain the initial high pH over a prescribed duration (such as a NATO designated duration of 30 minutes), to provide sufficient hypochlorite ions to effect decontamination—favoring oxidation of VX agent which avoids the formation of toxic hydrolysis byproducts, favoring hydrolysis of G-agents, and favoring oxidation of HD agents and avoiding HD reformation. Accordingly, the buffer must be capable of buffering the release of HCl due to hydrolysis of the chloroisocyanuric salts by water. Most preferably, the pH is maintained above 8.5 during the duration available for decontamination.

It has been determined that the most suitable buffering system is an inorganic buffering system, adjusted to an initial pH in the range of 10 to 11. Sodium salts, such as a mixture of sodium tetraborate decahydrate and anydrous sodium carbonate, are preferable since quaternary ammonium compounds result in depletion of hypochlorite through reaction with the hydrolysis product of hypochlorite, chloride ion.

The preferred solvent for the decontamination formulation of the present invention is water, including gray and seawaters.

The decontamination formulation may further optionally include small amounts (preferably <0.03%) of corrosion inhibitors such as sodium tolyltriazole, ammonium dimolybdate and sodium pentahydrate silicate to improve compatibility with use on metals.

Augmented Active Ingredients

The decontamination formulation may further optionally include lithium hypochlorite to augment the active hypochlorite content of the solution over a short term, thus providing a higher level of active species in the initial stages after the addition of water. Preferably, lithium hypochlorite is present in amounts in the range of from about 5 to about 10% by weight of the active ingredient dichloroisocyanuric acid salt and taking into account that commercially available lithium hypochlorite is normally only available as 30% pure. Alternatively, small amounts of Super Tropical Bleach (STB) or High Test Hypochlorite (HTH), below their solubilisation limits so that no solid or slurry results, could serve somewhat the same function as the addition of lithium hypochlorite.

The decontamination formulation of the present invention may further optionally include inorganic/organic bromide to increase the reactivity of the chloroisocyanuric acid and generate low levels of hypobromite and bromine chloride.

Optional Embodiments

Three embodiments are briefly described as follows and are more specifically disclosed in the following examples.

In a first embodiment of the present invention the decontamination formulation contains 9% sodium dichloroisocyanurate, a buffer mixture containing 0.0125M sodium tetraboratedecahydrate and 0.1M anhydrous sodium carbonate adjusted to a pH from about 10 to 11, using NaOH (full strength buffer), 9% surfactant and a total of 8% co-solvent, including co-solvent contained in the surfactant mixture. This formulation provides for maximal decontamination—capable of decontaminating the broad spectrum of CW and BW agents, in the liquid phase, in under 7 minutes, and provides foam production capable of coating vertical surfaces. The concentration of active ingredient of this first embodiment tends to compromise the performance of the resulting foam as a suppressant of dispersion or blast devices, likely due to the higher co-solvent and salt content.

In a second embodiment of the present invention, the decontamination formulation contains 6% dichloroisocyanuric acid salt, full strength buffer, 9% surfactant and a total of 8% co-solvent. This formulation provides for good decontamination and increased foam stability for decontamination of any agents or for clean up after a blast.

In a third embodiment of the present invention, the decontamination formulation contains 3% dichloroisocyanuric acid salt, a buffer in which the concentrations of the components have been reduced by ⅓ that described for full strength buffer (⅔ strength buffer), 3% surfactant and no extra added co-solvent. This embodiment, while it provides excellent blast suppression, provides slower reacting decontamination capability.

Method of Application

The decontamination formulation can be prepared either as a liquid or as foam. The preferred form is to create foam due to its ability to effectively coat surfaces, including vertical surfaces and to suppress vapor emissions.

Figure 1A:
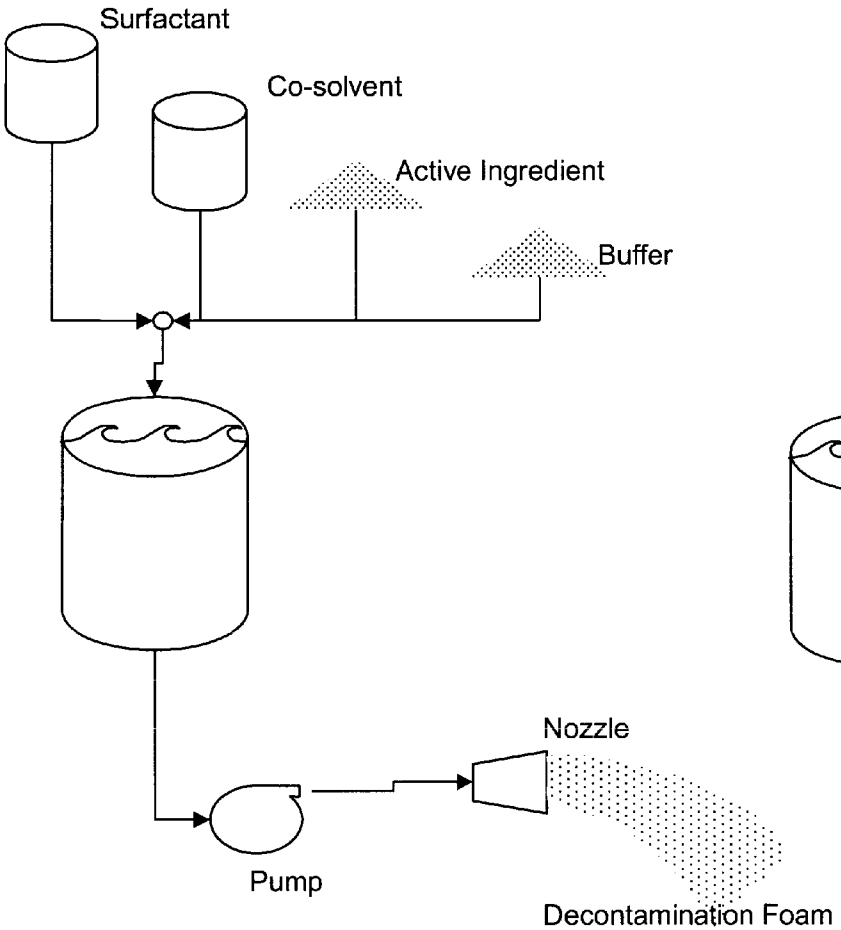

Having reference to FIG. 1*a*, the decontamination formulation of the present invention can be prepared by first combining in a single source solution in a plastic drum, water bladder or plastic container, at approximately the final percentages, the active ingredient, co-solvent, buffer, the surfactant and fresh or seawater. The source solution is then pumped to the contamination site. For foam application, the formulation is applied using high to medium pressure pumping equipment equipped with appropriate aeration nozzles.

Referring to FIG. 1*b*, in an alternate and staged method the active ingredient and buffer are made up separately from the co-solvent and surfactant/foam. This staged approach provides improved storage life after preparation. The active ingredient can be made up in a single solution concentrate of the highest achievable percentage soluble in water, about 30% by weight total in water. It follows that the higher the weight percent of soluble active ingredient, the less concentrate is required to be aspirated into the main stream to achieve maximum decontamination. This solution is stable for several hours. The buffer mixture is prepared in a second solution at or near the solubility limits of each of the buffer salts and the pH adjusted to provide an initial pH of 10 to 11. This concentrate is stable for long periods of time. The active ingredient and buffer can then be introduced, into a stream of co-solvent, surfactant and water for completing the formulation and initiating decontamination.

The concentrations of co-solvent and surfactant are dependent on one another and on the type of decontaminant applicator or inductor used. A synergistic effect can exist between these two ingredients. As well, the ambient temperature can influence the concentration of surfactant required. Therefore, one must consider these factors and adjust the concentration of the surfactant to suit the particular situation in which the formulation is to be used.

Regardless of the method of formation, most preferably, the decontamination formulation is prepared by adding into a stream of water, the ingredients in the following order; co-solvent and surfactant, active ingredient, and buffer.

The ingredients are pumped through an appropriate aeration nozzle to provide a relatively stable and thick foam. The nozzle should entrain sufficient air into the stream to create the foam without causing excessive back pressure.

The active ingredient and the buffer are added as concentrates to the stream of water and are diluted during the application process. The surfactant can be added simultaneously with the buffer, however it may be advantageous to add them separately (FIG. 1*b*) as the amount of surfactant required depends upon the ambient temperature, the surface being treated and the incident sunlight.

By adding the surfactant separately, wholly or as an optimizing addition to a solution already containing most of the decontamination ingredients, one can beneficially adjust the foam properties to the ambient conditions.

One further advantage to the staged approach is that hypochlorite or buffer are introduced to the stream after the pump and before the nozzle so that the pump is only exposed to water or possible pump-friendly co-solvent and surfactant. Greater pump life can be expected as it is not degraded or corroded by long-term exposure to potentially corrosive or abrasive ingredients.

In the alternative approach, all ingredients are combined in the source container (FIG. 1*a*). While this approach is simpler, it must be noted that the presence of the buffer mixture will immediately initiate degradation of the active ingredient so the lifetime of the formulation using this method of preparation may be more limited from the time at which they are mixed. Additionally, the pump will be exposed to the complete formulation and could corrode substantially faster, depending upon the materials of construction. In contrast, the lifetime of the active ingredient in water without the addition of the buffer mixture (FIG. 1*b*) is considerably longer.

Modifications to the above methods are possible. For example, the solutions could be mixed off-line in a series of drums or tanks and, when dissolved, the contents could be pumped to source containers permanently attached to the pumps or aspirators.

Kit

For field use, a practical approach is to provide appropriate quantities of each component in kit form and obtain a local source of water. Separate, lightweight containers such as plastic pouches or pails facilitate transport of the components to the decontamination site. For example, the active ingredient, which is in the form of a powder, can be weighed out in specific amounts and heat-sealed in a plastic pouch to keep it dry. Similarly, the buffer components, also available as solids, could be packaged individually or as a mixture with the active ingredient if moisture can be excluded.

The co-solvent can likewise be measured out in appropriate quantity, diluted slightly if necessary and stored in large plastic pails with tightly sealed lids. The surfactant can likewise be supplied in its original shipping pail or, if prepared locally, stored in pails in pre-measured amounts similar to the co-solvent. Alternatively, the co-solvent and surfactant can be provided as a mixture and packaged together. The solid ingredients are then dissolved into solution in water or seawater, which are subsequently added to a pumping system as described above to obtain the decontamination formulation of the present invention at the decontamination site.

EXAMPLES

The following examples are illustrative of the preferred embodiments of the present invention and are not to limit the scope of the invention.

Example 1 illustrates typical preparation of a decontamination formulation.

Example 2 illustrates the application and effectiveness of the formulation of Example 1 as applied in a field trial for destruction of a mustard chemical agent.

More generally, examples 3 through 5 illustrate various formulations and results for liquid phase reaction-decontamination of CB agents. Specifically, examples 3 and 4 illustrate liquid phase reaction-decontamination of G-Type Nerve and Mustard Agents and VX Nerve Agent.

Example 5 similarly illustrates liquid phase reaction-decontamination of a known nerve agent simulant, di-isopropyl fluorophosphate (DFP).

Example 6 illustrates the foam phase-detoxification of viable anthrax spores on military-spec painted metal coupons.

Examples 7 and 8 demonstrate field trial results for the decontamination of a military vehicle, particularly the destruction of mustard chemical agent and foam phase removal of radioactive dusts.

Example 1

The following decontamination formulation was prepared for the vehicle decontamination according to Example 2.

A source solution of water, buffer, co-solvent and surfactant was prepared. Separately, a solution of active ingredient was prepared. Separate preparation of the active ingredient postpones the initiation of the degradation of the hypochlorite precursor until mixed.

More particularly, a concentrate of the active ingredient was prepared from 72 liters of tap water and 18.6 kg of anhydrous sodium dichloroisocyanurate. The solid active ingredient was added to the water in a plastic waste overpack container and vigorously stirred with an industrial stirrer/homogenizer. The solution turned into an off-white milky liquid which, when gently warmed with the introduction of steam for less than five minutes turned into a translucent amber-colored fluid. Mechanical constraints for this particular experiment limited the solution concentration to a maximum of 5.6% active ingredient, 9% being achievable using different equipment as demonstrated in Examples 3–5.

The source solution was prepared with 303 liters of tap water, 16.73 liters of surfactant, 26.35 liters of polypropylene glycol 425 as co-solvent and inorganic buffer salts, more particularly, sodium tetraborate decahydrate and anhydrous sodium carbonate in sufficient amounts to provide concentrations of 0.0125M and 0.1000M respectively in the final solution. Sodium hydroxide was added in sufficient amounts to provide an initial pH of approximately 11, which would, after addition of the active ingredient, cause the resulting pH after stabilization to be from about 9.3 to about 9.7.

An NR-surfactant, modified from the Silv-Ex formulation, was used. Generally the composition of the NR-surfactant was, all referenced by weight, 30% $C_{8-10}H_{17-21}(OCH_2CH_2)_{2.3}OSO_3^-NH_4^+$, 15.5% $C_{11-13}H_{23-27}CH{=}CHCH_2{-}SO_3^-Na^+$, 20% polypropylene glycol 425, 5% alcohol mixture (of about 2% $CH_3(CH_2)_{11}OH$ and 3% $CH_3(CH_2)_{13}OH$, and the balance being water.

Note that the NR-surfactant already contained 20% by weight of co-solvent and thus only sufficient additional co-solvent (26.35 liters) was added to the source solution to obtain an 8% overall solution (29.75 liters).

The source solution and concentrate were separately stored in two plastic storage vessels. The source solution was pumped at 24 liters/min through pressure hose to a foam nozzle. The concentrate was introduced into the flow of source solution immediately downstream of the pump, through two eductors backed by small centrifugal pumps whose flow rates were constantly monitored. The combined eduction of the two units amounted to a total of 18.6% of the overall exit flow of foamed effluent from the nozzle. This combination provided a final active ingredient concentration of approximately 5.6% by weight equivalent of sodium dichloroisocyanurate dihydrate. Two eductors were provided in anticipation of alternate operation wherein each eductor would draw in a separate concentrate; one containing active ingredient, the other containing the buffer, co-solvent, and possibly, the surfactant components.

In operation, the combined effluent was fed through 40 m of standard high-pressure hose to a spray lance. Dissemination was achieved through attachment of a foam nozzle (9 US Gal/min) to the spray lance discharge. As a result, foam was readily generated by pumping the formulation through the system and applying the spray from the nozzle to the sides of the target vehicle.

Example 2

Figure 2A:
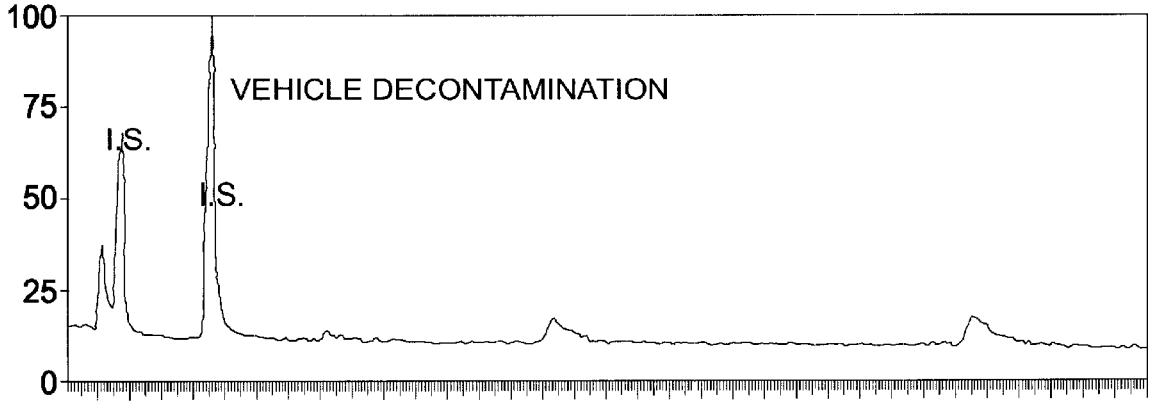
FIGS. 2*a*–2*c* are graphs showing detection for mustard agent, a reference mustard sample and a reference diethyl malonate sample respectively according to the decontamination of a vehicle set forth in Example 2.
Figure 2B:
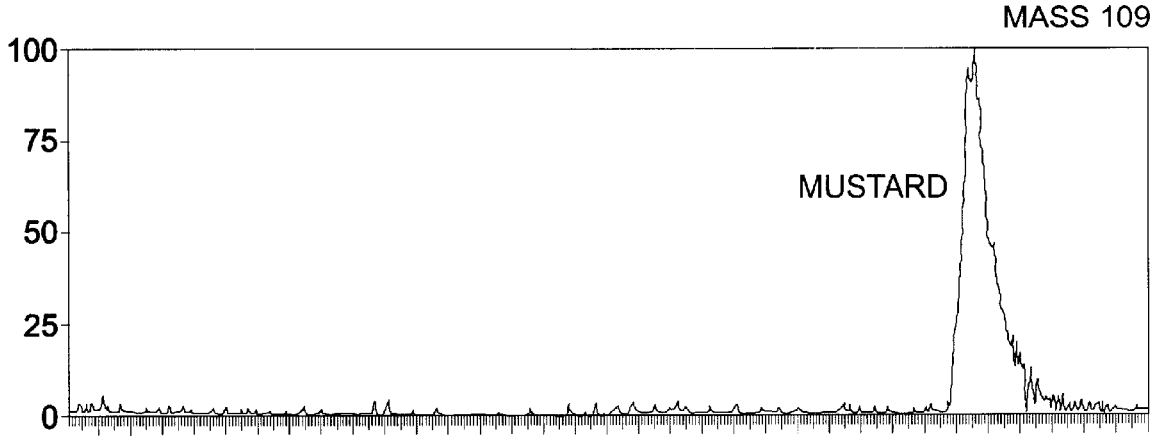
Figure 2C:
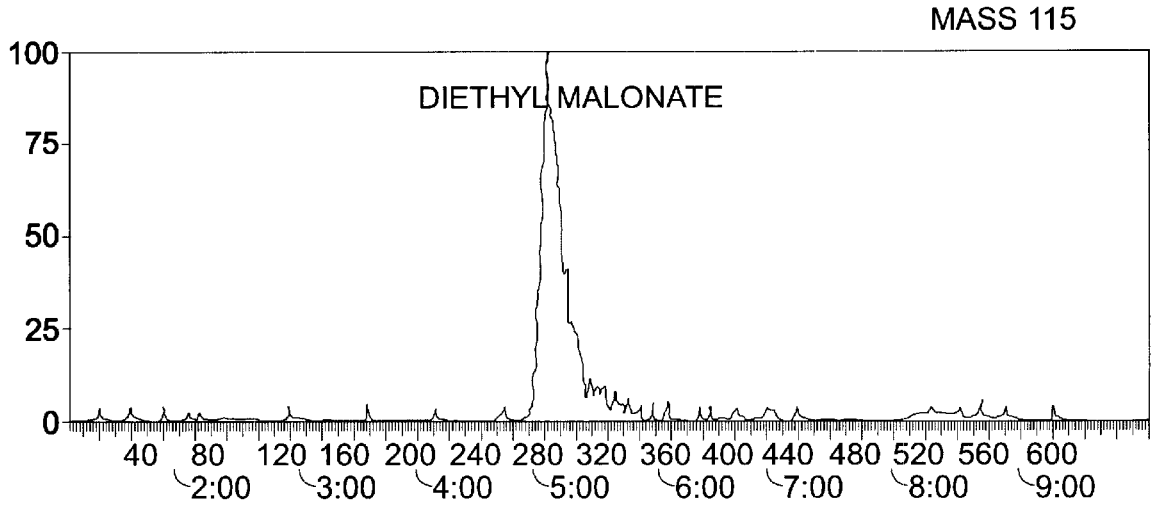
Figure 4:
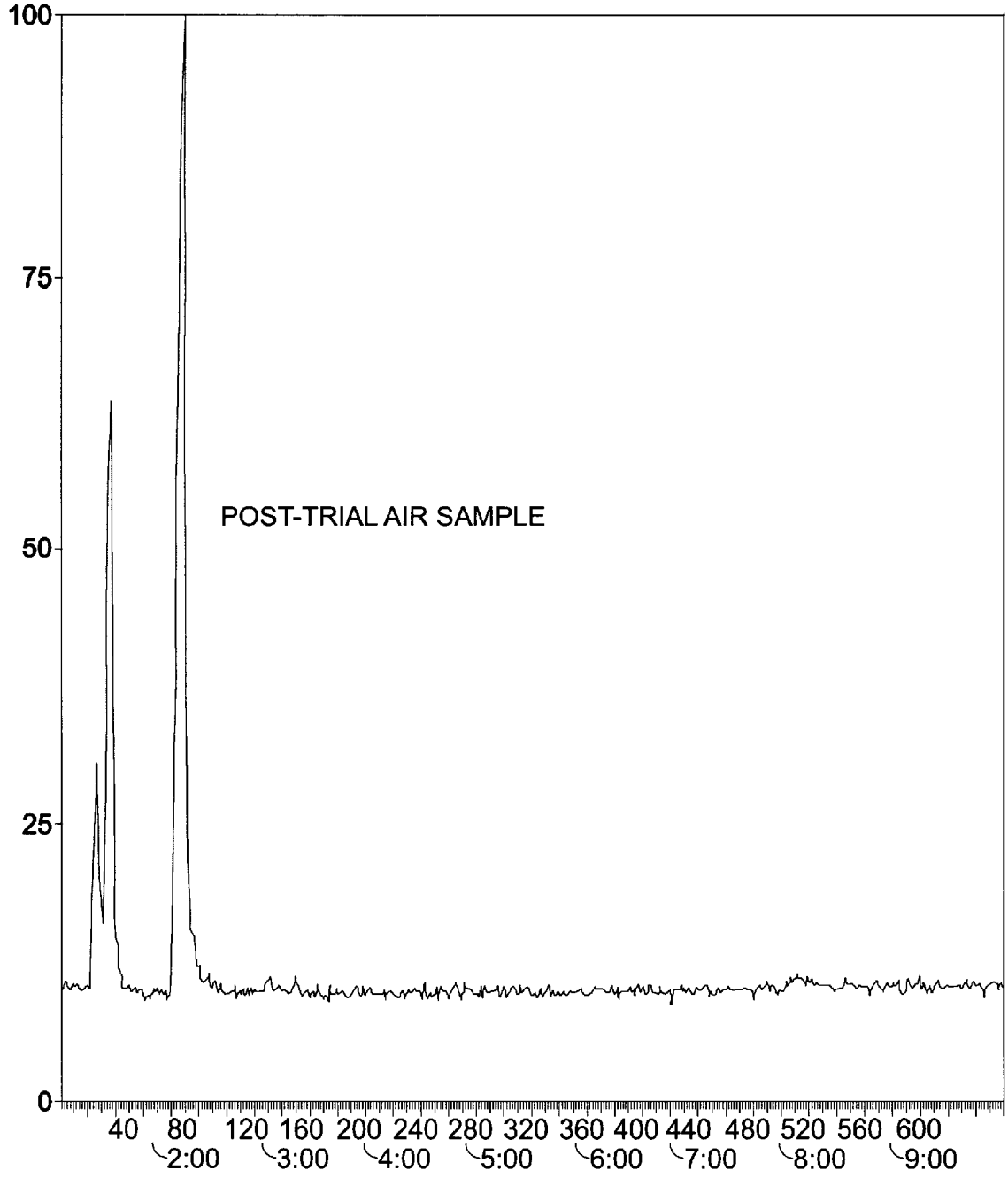
FIG. 4 is a graph showing the absence of mustard agent in air samples taken near the vehicle of Example 2 after it has been treated with a decontamination formulation of the present invention.

Using the formulation as set forth in Example 1, neutralization of mustard agent applied to a vehicle surface was evaluated in the field as follows. Approximately 150 ml of mustard was applied to the surface of a vehicle using a paintbrush. The presence of mustard agent was assessed and verified using a portable gas chromatograph/mass spectrometer (GC/MS). The decontamination formulation of Example 1 was applied to the contaminated side of the vehicle using the lance and nozzle followed by manual scrubbing of the surface using long-handled brushes. After a 30 minute wait period, the foam was washed away with water and the vehicle surface was re-surveyed using the GC/MS. FIG. 2 illustrates that an air sample taken near the contaminated vehicle before decontamination contained mustard agent, the top trace is the total ion current as recorded by a portable GC/MS which shows two large peaks due to internal standards (IS) and two lower peaks. The second trace (FIG. 2*b*) is an ion chromatogram set at m/z 109 and the bottom trace (FIG. 2*c*) is a separate ion chromatogram set at m/z 115 to detect a simulant, diethyl malonate, also present in the atmosphere from an earlier contamination. As shown in FIG. 3, a mass spectral analysis of the m/z 109 sample component of FIG. 2*b* confirmed that this component was mustard chemical agent with a 85.7% probability as compared to the bottom trace, which is an authentic mass spectrum of mustard stored in the search library. Turning to FIG. 4, once the vehicle was treated with the decontamination formulation, no further mustard was detected in air samples taken near the vehicle.

Examples 3–5

In each of Examples 3–5, quantitative analyses for residual agents were performed on a high pressure liquid chromatography (HPLC) system for separation of the reaction components, equipped either with a HPLC-UV detector in series with a commercially available dual flame gas chromatographic flame photometric detector (FPD) from Varian Associates, or, where possible, on a Hewlett-Packard 1100 LC-MS system equipped with a diode-array UV-VIS spectrophotometer and mass selective detector (MSD). The water used in the reactions, prepared solutions, and in the HPLC was distilled and deionized. The formulation for the surfactant/foam was first warmed to 32° C. to ensure homogeneity. CB agents and simulant DFP were provided by the Canadian Single Small Scale Facility at the Canadian Defence Research Establishment Suffield (DRES) in southern Alberta, Canada and Aldrich Chemical Company, respectively. GB stock calibration solution was prepared by weight in acetonitrile (AcCN) and several dilutions were prepared ranging from 25 to 900 ng/$\mu$L for calibration of the FPD, UV, and MSD responses. Stock solutions of the other CW agents were prepared volumetrically in AcCN and similarly diluted for calibration.

Unless otherwise specified, in a typical experiment, samples were prepared in 2.0 mL autosampler vials. The first addition was a water solution containing the surfactant and, if necessary, the co-solvent. This was followed by buffer concentrate, then the decontaminant concentrate which had been separately prepared by adding the active ingredient, anhydrous sodium dichloroisocyanuric acid (SD), to water and heating to 29° C. with stirring for 15–30 minutes. Finally, the CB agent was added defining time zero, and aliquots, at noted elapsed times, were directly injected into the LC. The temperature of the vial holder was maintained at 25.0° C. and a mini stirbar in the vial mixed the components. Fresh samples were prepared for each FPD analysis to obtain residual agent concentration profiles over time and these same solutions were subsequently analyzed by LC-MS.

Example 3

Having reference also to FIG. 5, the effectiveness of several decontaminant formulations against selected G-type nerve gases GB, GA and GD and mustard gas, HD, was determined. The formulations tested consisted of an active ingredient, a surfactant, an inorganic buffer mixture and, optionally, co-solvent, in excess of that already present in the surfactant mixture. The co-solvent values in FIG. 5 represent added co-solvent and that contained in the surfactant.

Three decontamination formulations were assessed for effectiveness against typical G-nerve agents; the mildest formulation, using 3% w/w SD, a ⅔ strength buffer, and 1.3% w/w surfactant; an intermediate strength formulation with 6% w/w SD, full strength buffer, 4.6% w/w surfactant and an additional 6.9% w/w to 7.8% w/w co-solvent, and a full strength formulation with 9% w/w SD, full strength buffer, 4.8% w/w surfactant and 6.9% w/w additional co-solvent. Although anhydrous SD was used in preparation of the solution, percentages are quoted in terms of the equivalent amount of dihydrate. Percentages (w/w) quoted for surfactant represent double-strength surfactant.

In order to standardize concentrations between experiments, the effectiveness was calculated as a percentage of residual agent.

Using 0.29% w/w GB, there was no evidence of residual agent in any of the LC-FPD or LC-MS analyses for the mildest and intermediate strength formulations (3% w/w and 6% w/w SD). GB was destroyed in each case before the first sample could be taken (0.43 and 1.13 minutes respectively). For the most potent formulation (9% w/w SD), only LC-FPD analysis was performed at 1.78 minutes elapsed time and no agent was detected indicating complete destruction of the agent within 1.78 minutes.

Using 0.29% w/w GA, only the mildest and intermediate strength formulations (3% w/w and 6% w/w SD) were evaluated. The mildest formulation was tested in two separate experiments. In the first, containing ~1.6% w/w surfactant, LC-FPD analysis indicated that GA was destroyed within 1.33 minutes. In the second, containing ~1.8% w/w surfactant, there was no evidence of GA in 1.07 minutes elapsed time (LC-FPD) or 3.43 minutes (LC-MS). For the intermediate strength formulation containing an additional 7.5% w/w co-solvent, there was no evidence of GA in 1.07 minutes elapsed time by LC-FPD or 3.35 minutes by LC-MS.

Using 0.29% GD, again only the mildest and intermediate strength formulations were each evaluated. The full strength formulation was not tested due to the success with the two milder formulations. The mildest formulation was tested and, in contrast to the other two G-agents examined, small amounts of residual GD appeared to be observed for the shortest reaction time sample. Specifically, as analyzed by LC-FPD, 5.0% residual agent appeared to be present at 1.07 minutes and 0.5% appeared to remain at 4.77 minutes, and the agent was completely gone by 10 minutes, as determined by LC-MS analysis. Similar results were observed using the intermediate solution containing 7.8% co-solvent. Complete LC-MS characterization of the peak eluting at GD in a stock solution of GD suggests that a trace of a GD-related impurity, methylpinacolylmethylphosphonate also eluted at this point, possibly contributing to the residual peak observed at short reaction times. Thus, although GD appears to be more difficult to destroy than GB or GA, the mildest formulation is still very effective against GD within acceptable time limits.

Using 0.27% w/w HD, again due to their success, only the mildest and intermediate strength formulations were evaluated. The mildest formulation was tested for effectiveness against HD in three separate tests. In the first test, there was no evidence of residual HD after 2.67 or 4.92 minutes (reaction solutions had to be mixed more vigorously than the other agents due to limited solubility of HD so earlier sampling was not possible). In the second test, no residual agent was detected after 3.0 or 62.1 minutes, however 6.2% of residual HD appeared to be present after 5.4 minutes assuming that the eluting peak was indeed HD. As a confirmatory test, an third experiment was performed and no HD was detected after 3.65 or 4.97 minutes.

It is therefore concluded that the mildest formulation is completely effective against this level of HD in less than 2.7 minutes.

The intermediate formulation also tested for effectiveness against HD and demonstrated no residual HD after 2.47, 5.27, or 53.3 minutes. Verification by LC-MS could not be performed as HD cannot be detected using positive API-ES under these conditions.

Example 4

Having reference also to FIG. 6, the effectiveness of several formulations against the nerve agent VX was determined.

Samples were prepared as described in Example 3. Two decontaminant formulations were assessed for effectiveness against VX-nerve agent: the mildest formulation (MILD) with 3% w/w SD, ⅔ strength buffer, and 1.3% w/w surfactant, and the full strength formulation (FS*) with 9% w/w SD, full strength buffer, 4.8% w/w surfactant and 6.9% w/w additional co-solvent. As with example 3, percentages quoted for surfactant represent double-strength surfactant.

Control formulations were also examined. These included a formulation containing only full strength buffer and surfactant (Buffer/Surf) and a formulation containing all ingredients of the full strength decontaminant but without active ingredient (FS*wo/SD).

In order to standardize concentrations between experiments, effectiveness was calculated as percentage of residual agent. In addition, an authentic sample of a known potential toxic product (Toxic Product), of hydrolysis of VX, S-(2-diisopropylaminoethyl) methylphosphonothioic acid was synthesized and characterized by LC-MS to be used as an indicator of unsuccessful detoxification of VX. All reaction mixtures were examined for the presence of this compound; the presence of significant quantities would be sufficient evidence to disallow the formulation as a possible decontaminant candidate. The results are summarized in FIG. 6.

In the first evaluation, the control formulation of buffer and surfactant (Buffer/Surf) was tested at a low concentration of VX (4 $\mu$L/mL). After six days, 42% of the VX remained and toxic product in significant quantity was detected. The control formulation of full strength formulation without active ingredient (FS*wo/SD) was tested against a concentration of 12 $\mu$L/mL of VX. Again, significant quantities of VX and toxic product were found at 125 minutes and 6 days. Additionally, there was evidence of VX droplets in the solution at 125 minutes indicating that saturation levels of VX were present in solution and that removal of VX from the system was slow. When full strength formulation with SD was employed in excess (18.2:1 active species/VX), all VX was destroyed in less than 7 minutes with no evidence of toxic product.

A more extensive examination of the temporal effectiveness of the mildest formulation was undertaken in which the stoichiometric ratios of concentrations of VX to active chlorine present in solution were varied. For the lowest ratio (~6:1), effective decontamination of VX was not achieved although only small traces of toxic product were observed. On the other hand, if the ratio was ~16–18:1, complete decontamination without significant production of toxic product was achieved. As shown in FIG. 6, the mildest formulation at a ratio of 18.2:1 is completely effective in less than eleven minutes. A similar formulation reacting at a ratio of 29:1 resulted in similar effectiveness, however this is most likely due to the fact that the trace recorded by the LC-MS is at its detection limit using this procedure.

An analysis of the mild formulation without added VX did not register any response for VX eliminating the possibility of a false positive VX result due to the formulation itself.

In conclusion, even the mildest formulation is highly effective against VX provided that the ratio of reactant to agent is maintained over at least 17:1. This finding is in accordance with statements made in Y-C Yang, J. A. Baker, and J. R. Ward, Chem Rev., 1992, 92, p1731, in which the authors state that greater than 10 moles of active chlorine are required to oxidize 1 mole of VX.

Example 5

Having reference also to FIG. 7, the effectiveness of several decontaminant formulations was tested against diisopropylfluorophosphate (DFP), a compound often employed as a simulant for G-type nerve gases. Formulations in which the active ingredient, sodium dichloroisocyanurate (SD), was augmented by lithium hypochlorite (30% LiOCl) and potassium bromide (KBr) were also tested. As with the previous examples, the percentages quoted for surfactant represent double-strength surfactant.

Following introduction of surfactant and, if applicable, co-solvent, active ingredient (SD) was added as a 30% concentrate prepared in distilled, deionized water by adding solid SD to a measured amount of water which was then heated to 29° C., with stirring, for 20–30 minutes. When SD/LiOCl combinations were used, a concentrate was prepared and added to the reaction solution in a similar manner. Constant pH was maintained at 9.5 using an automatic titrator adding dilute NaOH. As a final step, the DFP was weighed out and added to the solution, defining time zero for the reaction. At timed intervals (5, 10, 15, 30, 60 and 120 minutes), aliquots were taken from the reaction solution, delivered into a quench vial containing aqueous hydrogen peroxide in methanol or isopropanol, and the aliquot weight recorded, along with the exact time of the quenching. Each quenched sample was then analyzed by HPLC.

In order to standardize concentrations between experiments, the effectiveness was calculated as percentages of residual DFP.

Figure 8:
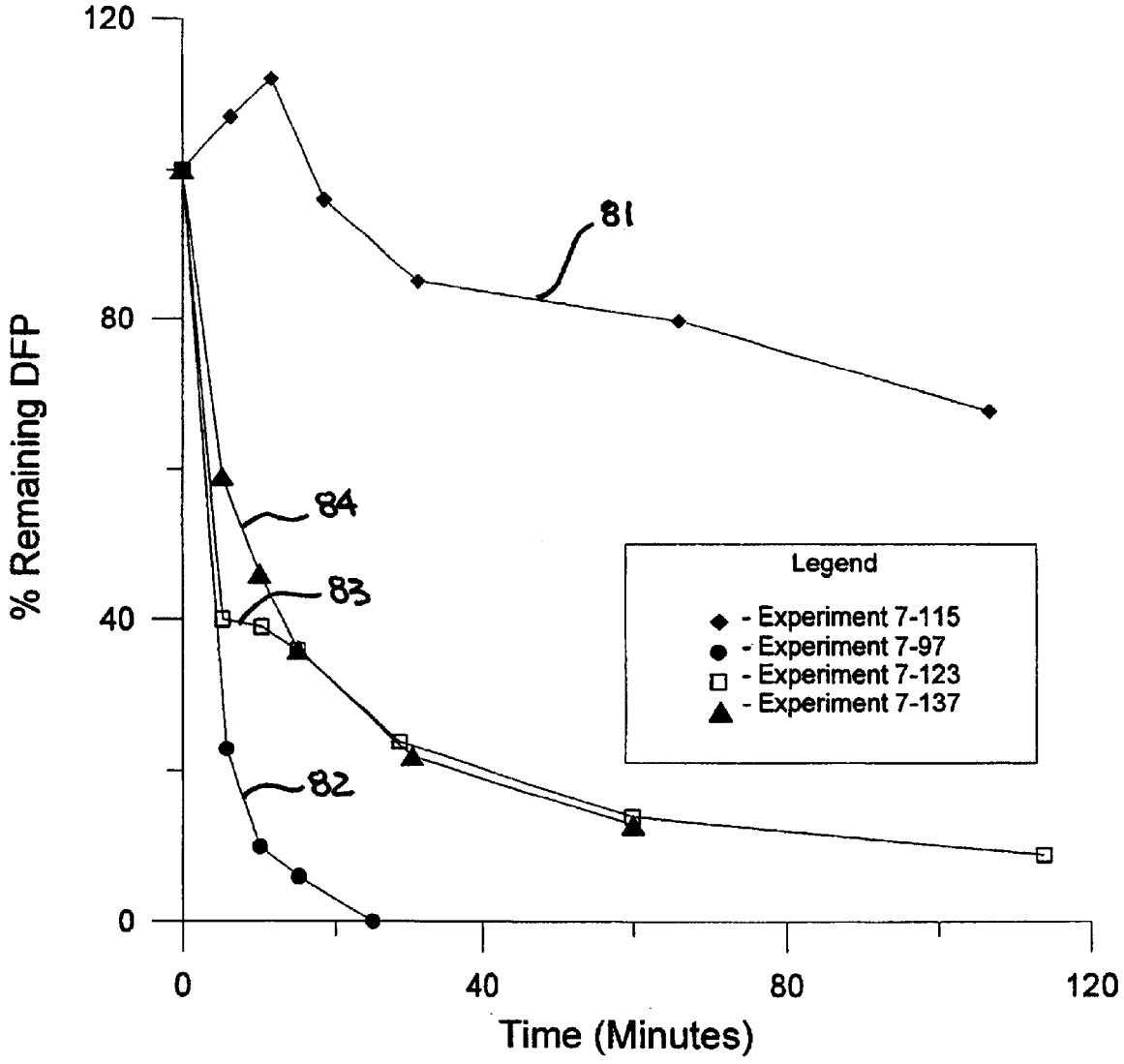
FIGS. 8–10 are graphs demonstrating the neutralization of DFP over time, according to Example 5, and specifically for formulations comprising the active ingredients SD alone, SD and KBr, and SD and LiOCl respectively.
Figure 9:
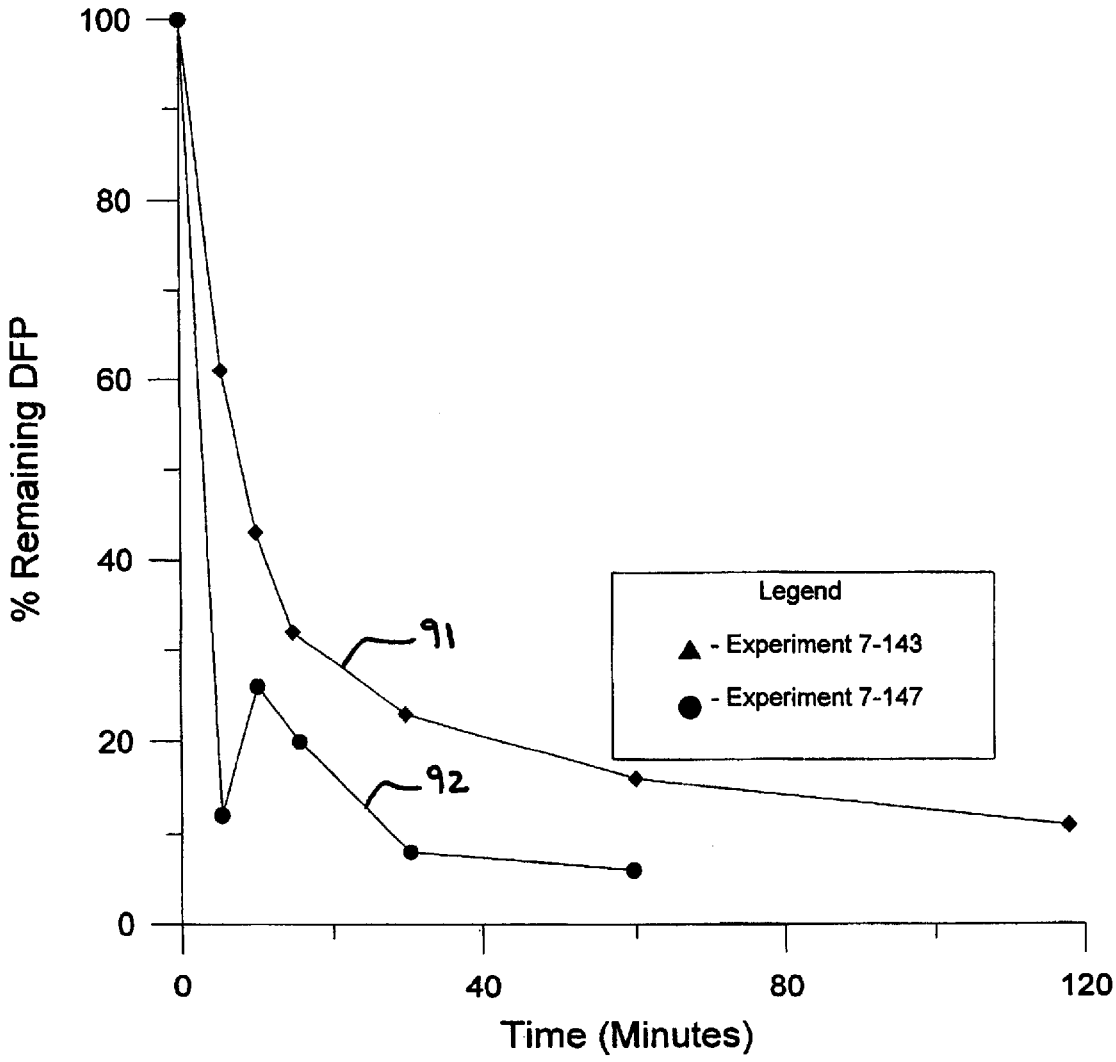
Figure 10:
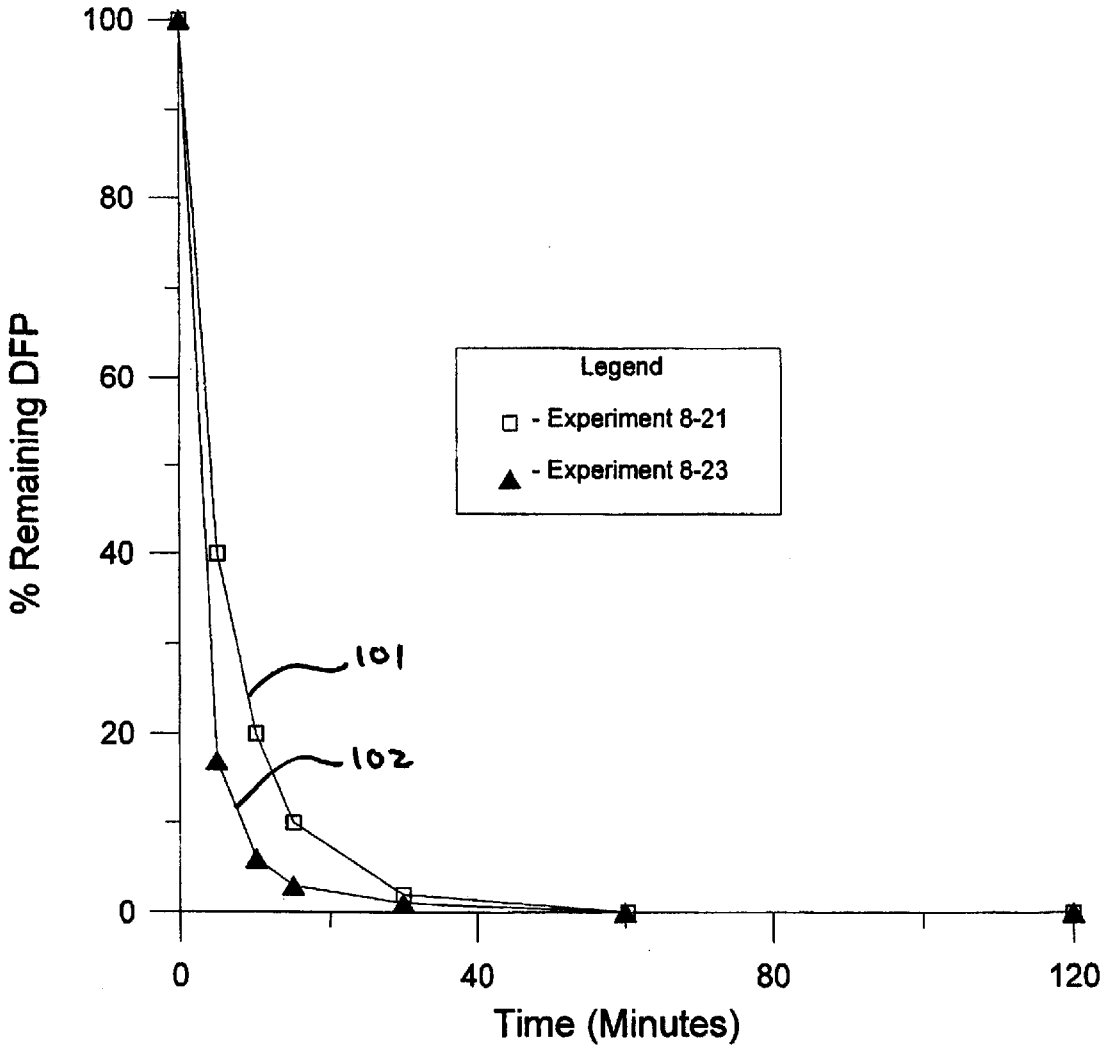

The results and experimental parameters are summarized in the table of FIG. 7 and the graphs of FIGS. 8–10. The table of FIG. 7 is divided top down into three sections representing the three formulations of SD, SD+KBr, or SD+LiOCl respectively.

In the first formulation (SD) and having reference to FIGS. 7 and 8, the results of a control containing no active ingredient, surfactant or co-solvent and various formulations of SD, co-solvent and surfactant, at pH 9.5, are illustrated.

As a control for comparison purposes, and entitled test 7-115, the disappearance of DFP in aqueous solution at pH 9.5 by unaided hydrolysis was monitored. The % of DFP remaining over time is plotted on FIG. 8 as line 81 wherein the control indicated an apparent initial increase in the DFP followed by a decrease over time to a value of 68% at 107 minutes. The calculated percentage of DFP remaining at 30 minutes was 87%.

The DFP response for a similar test 7-97 at pH 9.5, in which only SD was added, is plotted on FIG. 8 as line 82 and illustrates a rapid drop over time to a value of zero at approximately 30 minutes.

In two additional tests, 7-123 and 7-137, co-solvent polypropylene glycol 425 (7.2% w/w and 7.9% w/w respectively) was added to the water, held at pH 9.5 in the reaction vessel and stirred. SD (7.97% w/w and 7.42% w/w respectively) and finally DFP (1.34% w/w and 1.25% w/w respectively) were added. Test 7-137 was performed with the addition of surfactant (3.5% w/w) along with the co-solvent.

Plotted as lines 83 and 84 respectively, there was an exponential decrease of the percentage of residual DFP with time. However, the curve is shifted upwards from that of the reaction of SD alone with DFP at pH 9.5, and, in fact, the DFP was not destroyed in two hours. At the 30-minute mark, 25% of the DFP remained in the reaction solution with co-solvent alone and 21% with the addition of surfactant and co-solvent.

It is clear that the addition of SD, whether alone or in the presence of co-solvent and surfactant significantly increases the rate of hydrolyses of DFP but that both of these other additives has a negative effect on reaction rate.

In the second formulation and having reference to FIGS. 7 and 9, the results for controls and the effect of augmenting the active ingredient with the addition of KBr to SD with co-solvent and surfactant is demonstrated. Since the addition of co-solvent and NR-surfactant demonstrated a retarding effect on the rate of hydrolysis of DFP, the ability of KBr when added to the SD to offset this effect was investigated. As a control, the results from a test 7-143, plotted as line 91, with both co-solvent (6.3% (w/w)) and surfactant foaming agent (3.4% (w/w)) in the reaction solution were compared to a similar reaction at pH 9.5 involving added KBr. In the control case, there was residual DFP after two hours and 23% remained after 30 minutes.

In test 7-147, a KBr (0.1 M) solution held at pH 9.5 was substituted in place of water and the disappearance of DFP was determined. As plotted line 92 shows, although the initial value at five minutes appears to be anomalously low (12% DFP) since the DFP appears to increase to 26% at 10 minutes then gradually decrease with time, it is clear that the rate of hydrolysis of DFP has increased relative to the control formulation. The DFP did not reach zero within one hour and the calculated percentage of DFP remaining at 30 minutes was 8%. Clearly, addition of KBr assists in the rate of hydrolysis of DFP in the presence of surfactant and co-solvent.

In the third formulation and having reference to FIGS. 7 and 10, the results of a control and a formulation augmented by the addition of LiOCl to the SD are illustrated. As an alternative to adding relatively insoluble KBr for increasing overall hydrolytic reactivity, a soluble hypochlorite, LiOCl, was substituted. As a comparison, a first test, plotted as line 101, was performed in which the reactivity of SD (11.32% (w/w)) in a solution containing surfactant (1.5% (w/w)) and being held at pH 9.5 was examined. The DFP decreased with time until it was undetectable after 0.5 hours. The calculated percentage of DFP at 30 minutes was 2%.

In a second test 8-23, plotted as line 102, LiOCl at 0.19% w/w was added to a solution with SD (6.52%) and the surfactant (1.5% (w/w)) and maintained at pH 9.5. The weight of the LiOCl was 3.0% of the SD. The DFP at five minutes was less than 20% of the initial value and continues to decrease with time. The calculated percentage of DFP remaining at 30 minutes is only 0.5%.

Clearly, the substitution of LiOCl to a lower concentration of SD leads to a solution with more reactivity toward DFP than one with SD as the only active ingredient. Also, when compared to Example 3 above, it is apparent that DFP is much more resistant to hydrolysis in this system than are the G-agents it was proposed to simulate.

Example 6

The effectiveness of foam phase-detoxification of anthrax spores was determined. A suspension of *Bacillus anthracis* (Ames strain) was heat shocked to kill the vegetative cells, leaving only the viable spores. Small metal coupons, painted as per in-service military vehicles, were cleaned with ethanol wipes and sterilised by autoclaving. Each coupon to be used was spotted with 200 $\mu$L spore suspension, distributed over the surface of the coupon as 60–70 small droplets and allowed to dry overnight in a biosafety cabinet in a Level 3 Biocontainment laboratory.

Two trials were performed on two separate days using freshly prepared foam formulations. Each trial used two of these coupons, one to test the decontamination formulation and one to act as a control. Each coupon was placed in a 100 mm petri dish, supported to keep it from coming in contact with the bottom of the dish and covered with either the decontamination foam of the present invention or a control foam not containing the decontaminant active ingredients. The lid of the petri dish was replaced and twisted to ensure that the foam contacted the entire coupon. After 30 minutes each coupon was removed from the petri dish using forceps, rinsed with sterile PBS, then swabbed twice over its entire surface with a sterile sampling swab. The swab was placed in 5 ml of Heart Infusion broth and vortexed.

In both trials, 200 $\mu$L of neat broth from the decontamination foam-treated coupon and 200 $\mu$l of a $1\times10^{-4}$ dilution (in PBS) of the broth from the control foam-treated coupon were plated onto each of four Blood Agar plates. The plates were incubated overnight at 37° C. and the Colony Forming Units (CFU) observed the following day, are given in Table II. The Control foam results are shown multiplied by $10^4$ to adjust for the $10^{-4}$ dilution.

Trial 1 and Trial 2 indicate, respectively, that, on average, only 0.0108% and 0.00109% of the original material on the decontamination foam-treated coupons remained viable, translating into a 99.989% and 99.999% kill for simple contact with the decontamination foam for a period of 30 minutes.

TABLE II

Data from Anthrax Spore Decontamination Trials.

| | Colony Counts | | | |
|---|---|---|---|---|
| Experiment | Plate 1 | Plate 2 | Plate 3 | Plate 4 |
| Trial 1-Decon foam | 33 | 26 | 28 | 21 |
| Trial 1-Control foam | $22\times10^4$ | $22\times10^4$ | $29\times10^4$ | $28\times10^4$ |
| Trial 2-Decon foam | 13 | 10 | 5 | 3 |
| Trial 2-Control foam | $66\times10^4$ | $72\times10^4$ | $68\times10^4$ | $78\times10^4$ |

Example 7

Figure 11:
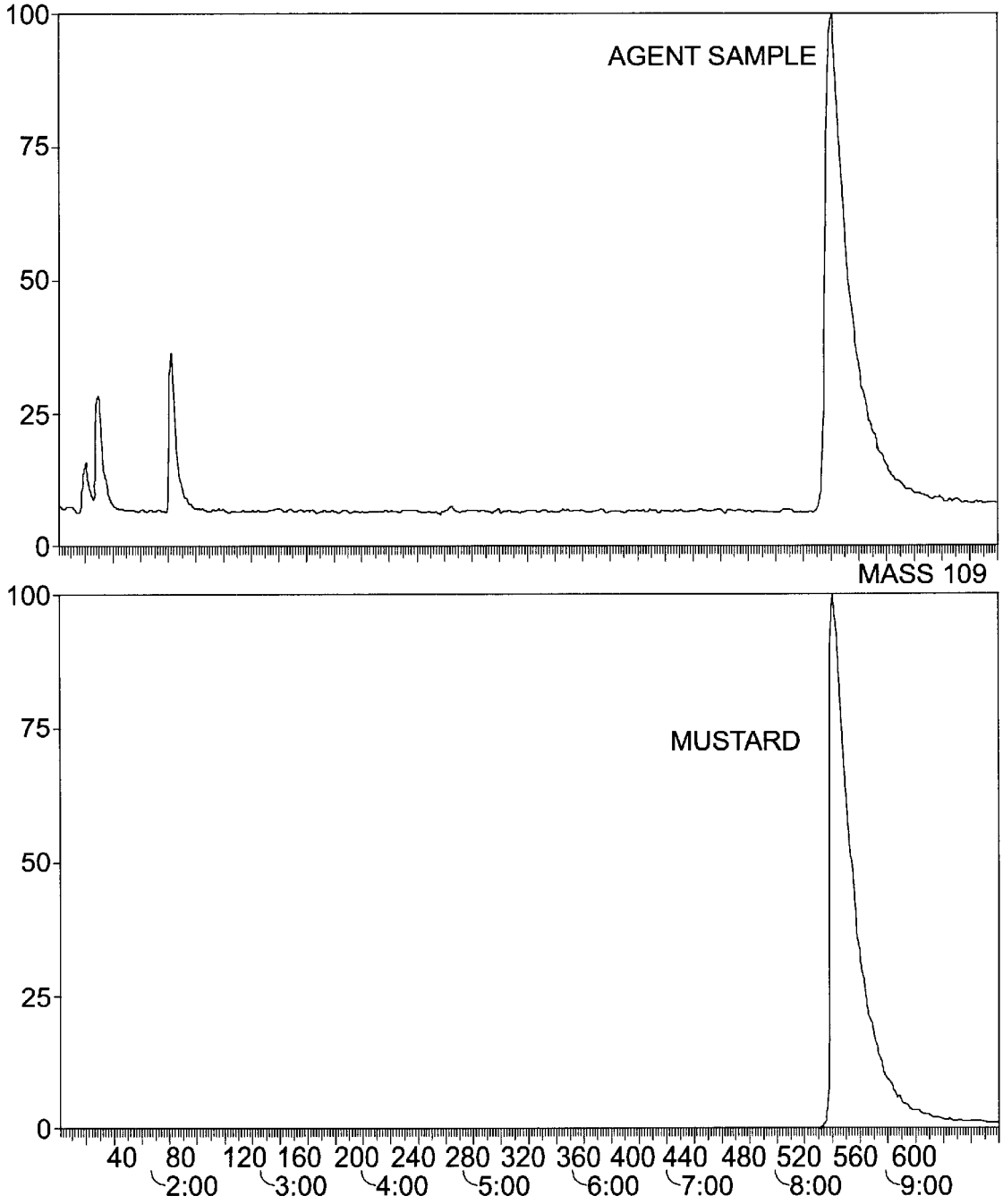

Having reference to FIGS. 11–13, the neutralization of mustard chemical agent on a military vehicle surface was evaluated in a field trial using a formulation comprising of a mixture of sodium dichloroisocyanurate and LiOCl as active ingredients. The vehicle used was a U.S. M113A armored personnel carrier subsequently coated with Canadian Forces specification Chemical Agent Resistant Coating (an agent-resistant two-pot polyurethane paint).

In this decontamination trial approximately 75 mL of munitions-grade mustard agent was painted onto the side and end of the vehicle. The vehicle was located inside a plastic-lined containment pit.

In FIG. 11, a mass spectral analysis of the total ion and reconstructed m/z 109 chromatograms confirmed that the contaminant in the bottle and painted onto the vehicle was, indeed, mustard by reference to an authentic mass spectrum of mustard stored in the search library (FIGS. 11, 12). Handheld Chemical Agent Monitors (CAMs) exhibited strong H-mode mustard responses and 3-Way Detector Paper displayed the characteristic red colour response indicative of blister agents when pressed onto the contaminated surface of the vehicle.

Figure 13A:
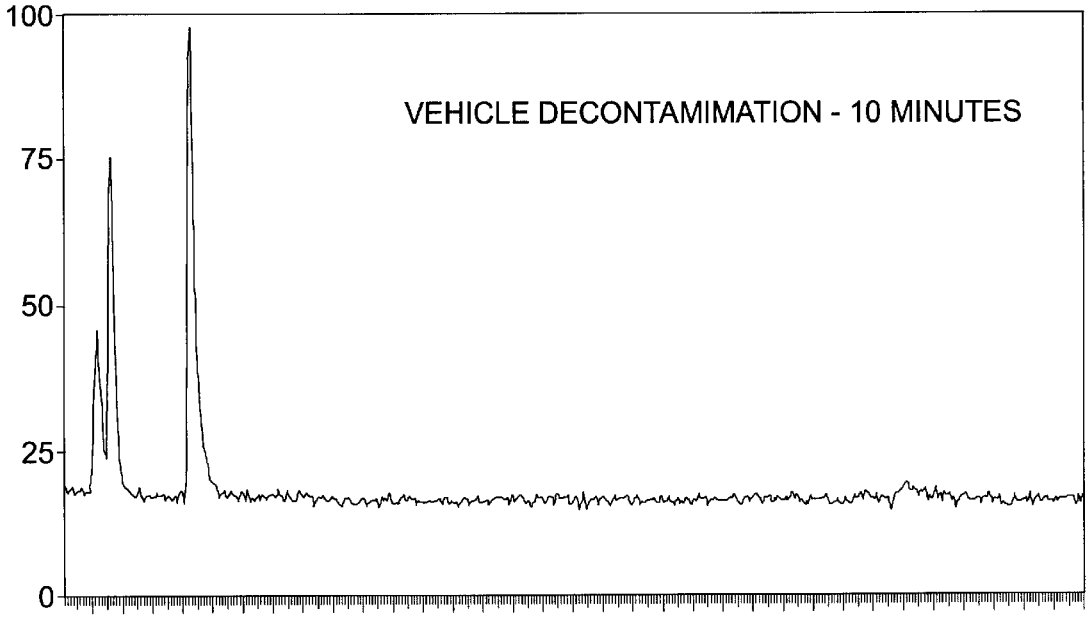
Figure 13B:
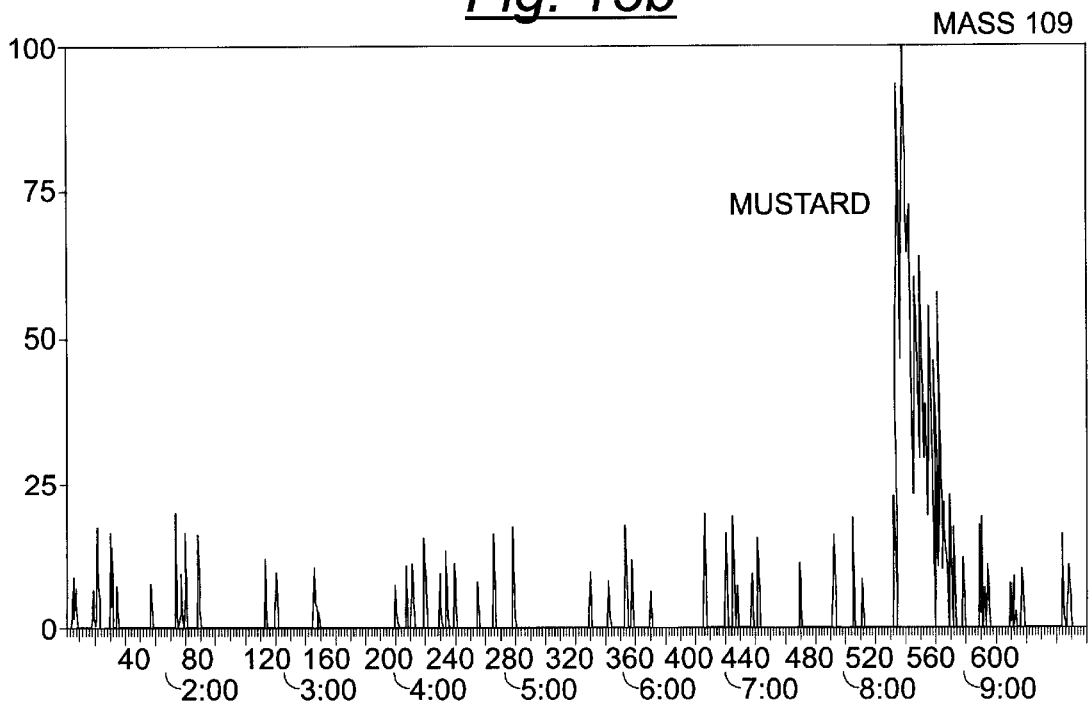

Referring to FIG. 13*a*, the decontamination formulation was then applied to the contaminated vehicle using a high capacity pump and two hoses fixed with foam nozzles. The vehicle was then scrubbed using long-handled brushes. During and following these steps, readings were made of the air around and downwind of the vehicle. Immediately, Chemical Agent Monitor (CAM) and air sample surveys conducted around the vehicle during the scrubbing procedure failed to detect the presence of mustard vapour, as shown by the GCMS results of FIG. 13*a* (total in chromatogram) and FIG. 13*b* (m/z 109 reconstructed mass chromatogram characteristic of mustard) compare to the corresponding traces in FIG. 11.

Following a short (<30 min) rest period, the foam was washed away with water and the air near the vehicle surface surveyed against using CAMs and the GCMS. Once the vehicle had been treated, CAM surveys conducted close to the vehicle surface showed no response, indicating mustard vapour was not present.

Figure 14:
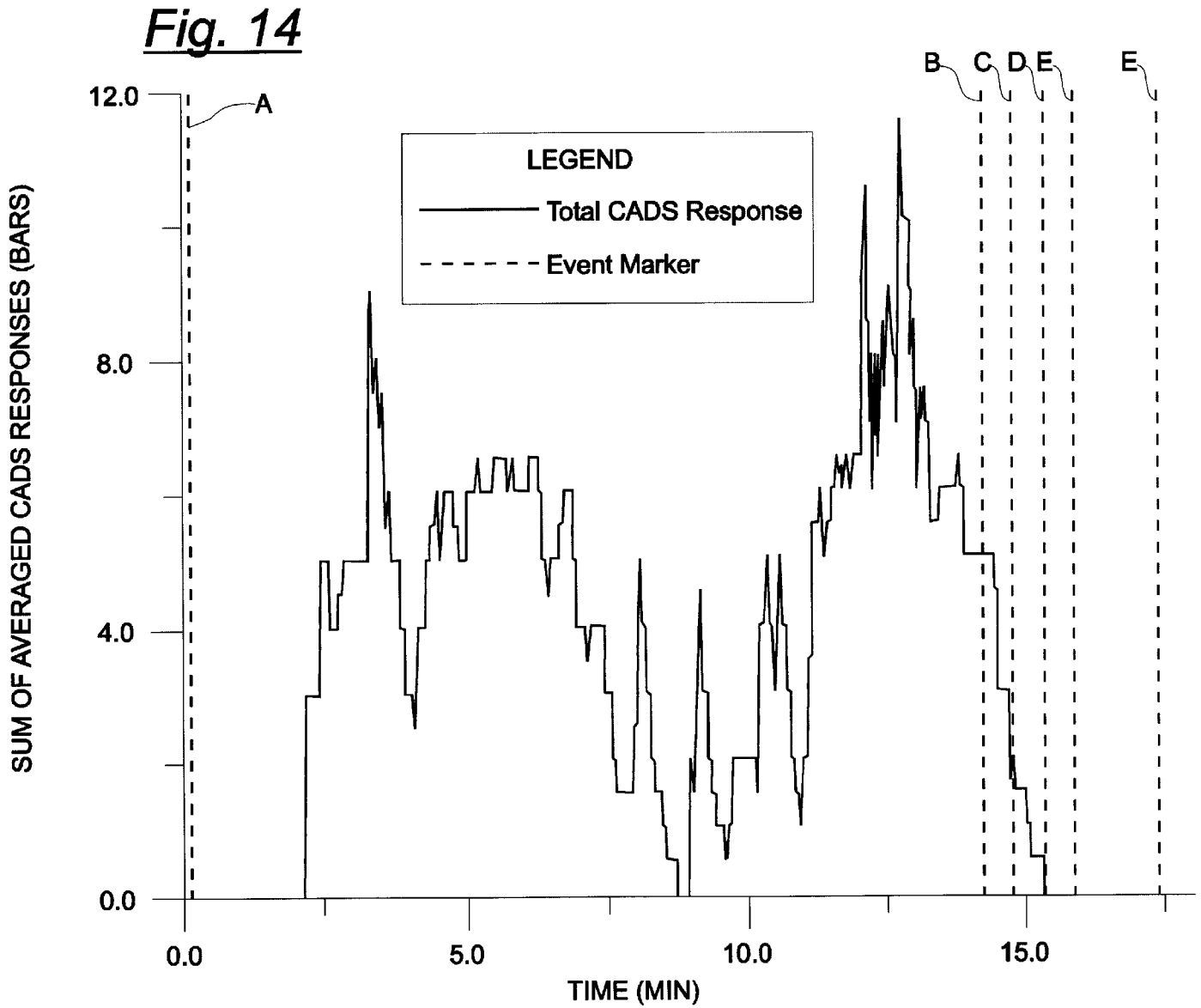

Having reference to FIG. 14, the combined responses. from four Chemical Agent Detection Systems Mark II (CADS II) stations deployed around the vehicle are illustrated. Each CADS II station comprises two CAMs. In this figure, the readings of all eight CAMs (four CADS II stations×2) were summed and displayed. The vertical bars in the figure denote significant actions on the part of trial personnel. Gross contamination of the vehicle was initiated at point A and decontamination commenced at point B. By point C, the audible alarm from the CADS II central control unit (CCU) had silenced and from point D onward, no further detection or bar reading of mustard vapor was observed. Thus, this formulation applied in this manner is effective in suppressing agent vapor from a freshly contaminated-coated military surface immediately and is effective in decontaminating mustard-contaminated military vehicles within a 30-minute period after application.

Example 8

Figure 15:
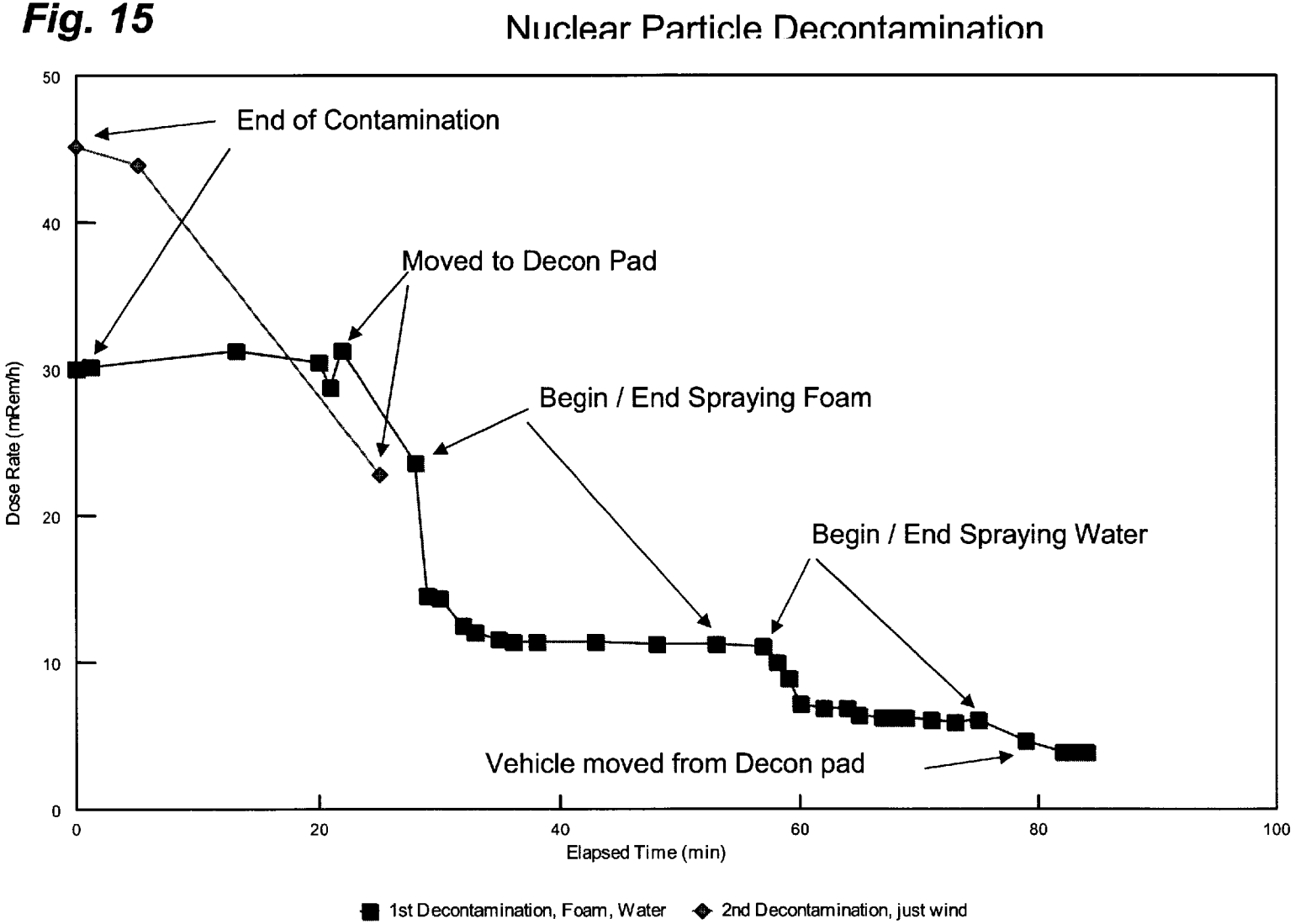
FIG. 15 illustrates the removal of radioactive dusts from a vehicle according to Example 8.

Having reference to FIG. 15, the effectiveness of the foaming agent by itself to effect decontamination of radioactive dusts from the exterior surface of an armored vehicle was demonstrated. The vehicle, a French AMX-10 Armored Personnel Carrier, was contaminated by spraying the exterior with $^{140}$La particles (100–200 $\mu$m) to simulate surface contamination as might be caused by driving across contaminated dusty terrain. Decontamination formulation using Silv-Ex surfactant was sprayed over the surface of the vehicle using a powered pressure washer fixed with an air induction foam nozzle of the type normally used in applying fire-fighting foams. Subsequent to the application of decontaminant, the vehicle was towed to a sensing frame where radiation measurements on the exterior could be made. In FIG. 15, the radiation level measured inside the vehicle in the first trial was observed to be in the order of 30 mRem/hr. After towing to the decontamination site and commencing application, the radiation level was observed to drop significantly (to approximately 11 mRem/hr) presumably due to foam layers dropping off the sides of the vehicle during the application stage. The radiation level flattened off over the course of the decontamination probably due to residual particles remaining on the vehicle in areas where the foam could not drop off (top, crevices) readily. On commencement of rinsing of the vehicle with water, the radiation level dropped even further (to approx. 6 mRem/hr) presumably due to flushing off some of the remaining radioactive particles. A map of the radiation emitted from the exterior surface of the vehicle as sampled by a frame of 80 probes confirmed that the radiation had been significantly reduced by decontamination using Silv-Ex-based decontamination foam.

In a subsequent trial, the same vehicle was contaminated to a level of approximately 45 mRem/hr. During movement of the contaminated vehicle to the site of decontamination, significant loss in the level of radioactivity was observed. The loss was such that the trial was terminated. It was apparent that the exterior surface, having been previously cleaned in an earlier trial, did not retain radioactive particles sprayed onto it. In other words the surface had been degreased and dust adherence had been significantly decreased, suggesting an additional benefit to the use of the formulation.

In a related examination in which paint panels were contaminated and subsequently decontaminated by dry scrubbing, the standard approach for decontamination of radioactive particulate matter was observed to attain a low level of 0.55 mRem/hr whereas decontamination with Silv-Ex-based decontamination foam reduced the radiation to a level of 0.33 mRem/hr after one application and 0.22 mRem/hr after a second decontaminant application, both of which surpass the standard approach for addressing this hazard.

The embodiments of the invention for which an exclusive property or privilege is claimed are defined as follows:

1. A decontamination formulation comprising:

(a) from about 1% to about 15% by weight of chloroisocyanuric acid;

(b) from about 1% to about 10% by volume of a co-solvent selected from the group consisting of polypropylene glycol, polyethylene glycol , and derivative thereof and mixtures thereof;

(c) from about 1% to about 15% by volume of a surfactant;

(d) a buffer to maintain said formulation at a pH from about 11 and which fails over time allowing the pH to fall to a pH of about 8.5; and (e) the balance being water.

2. A decontamination formulation of claim 1, wherein the chloroisocyanuric acid is in an amount from about 3% to about 9% by weight.

3. The decontamination formulation of claim 1, wherein said chloroisocyanuric acid is selected from the group consisting of an alkali metal salt of monochloroisocyanuric acid, dichloroisocyanuric acid, and a combination thereof with cyanuric acid.

4. The decontamination formulation of claim 3, wherein said alkali metal salt of dichloroisocyanuric acid is sodium dichloroisocyanurate.

5. The decontamination formulation of claim 1, wherein the buffer maintains the pH of the formulation above 8.5 for at least 30 minutes.

6. The decontamination formulation of claim 1, wherein the co-solvent is in an amount of from about 6% to about 10% by volume.

7. The decontamination formulation of claim 1, wherein polypropylene glycol has the chemical formula $R^1$—$(OCH(CH_3)CH_2)_n$—$OR^2$, where $R^1$ and $R^2$ are independently H, an alkyl, or an ester group and n>1.

8. The decontamination formulation of claim 7, wherein said alkyl group representing $R^1$ or $R^2$ are independently selected from the group consisting of a methyl, ethyl, propyl, and butyl group.

9. The decontamination formulation of claim 7, wherein at least one of said $R^1$ or $R^2$ is hydrogen.

10. The decontamination formulation of claim 7, wherein $R^1$ and $R^2$ are hydrogen.

11. The decontamination formulation of claim 1, wherein said polypropylene glycol derivative is a partially etherified polypropylene glycol.

12. The decontamination formulation of claim 11, wherein said partially etherified polypropylene glycol has the formulae $R^1$—$(OCH(CH_3)CH_2)_n$—$OR^2$, where one of $R^1$ or $R^2$ is independently H, or an alkyl group and $n \geqq 1$.

13. The decontamination formulation of claim 12, wherein said $R^1$ or $R^2$ are independently selected from the group consisting of a methyl, ethyl, propyl, and butyl group.

14. The decontamination formulation of claim 13, wherein at least one of $R^1$ or $R^2$is hydrogen.

15. The decontamination formulation of claim 1, wherein said buffer is capable of initially maintaining said formulation at a pH of from about 10 to about 11.

16. The decontamination formulation of claim 1, wherein said buffer comprises a mixture of sodium tetraborate decahydrate, anhydrous sodium carbonate and sodium hydroxide.

17. The decontamination formulation of claim 1, wherein said buffer comprises a mixture of sodium tetraborate decahydrate, anhydrous sodium carbonate and sodium metasilicate pentahydrate.

18. The decontamination formulation of claim 1, wherein said surfactant comprises a composition of the formulae $[R(OCH_2CH_2)_nX]_aM_b$, where R is an alkyl group having from eight to eighteen carbon atoms; n is an integer from 0 to 10; X is selected from the group consisting of $SO_3^{2-}$, $SO_4^{2-}$, $CO_3^{2-}$ and $PO_4^{3-}$; M is an alkali metal, alkaline earth metal, ammonium derivative or amine derivative; a is the valence of M and b is the valence of $[R(OCH_2CH_2)_nX]$.

19. The decontamination formulation of claim 1 wherein said surfactant comprises a composition of the formulae $[R—CH{=}CH(CH_2)_m—X]_aM_b$ where R is an alkyl group having from eight to eighteen carbon atoms; m is an integer from 0 to 3; X is selected from the group consisting of $SO_3^{2-}$, $SO_4^{2-}$, $CO_3^{2-}$ and $PO_4^{3-}$, M is an alkali metal, alkaline earth metal, ammonium derivative or amine derivative; a is the valence of M and b is the valence of $[R—CH{=}CH(CH_2)_m—X]$.

20. The decontamination formulation of claim 1 wherein said surfactant further comprises a compound of the formula R—OH, where R is an alkyl groups having from eight to sixteen carbon atoms.

21. The decontamination formulation of claim 1, further comprising lithium hypochlorite in an amount of from about 5% to about 10% by weight of said chloroisocyanuric acid salt.

22. A method of preparing a decontamination formulation comprising the steps of adding to a stream of water:

(a) a first aqueous solution comprising of up to about 30% by weight of chloroisocyanuric acid;

(b) a second aqueous solution comprising a mixture of inorganic buffer salts adjusted to an initial pH of about 10 to 11 and capable of maintaining the pH of said decontamination formulation from about 11 and which fails over time, allowing the pH to fall to a pH of about 8.5;

(c) a co-solvent selected from the group consisting of polypropylene glycol, polyethylene glycol and a derivative thereof; and (d) a surfactant.

23. The method of claim 22, wherein the surfactant is a foaming agent.

24. The method of claim 22, wherein the surfactant is a foaming agent comprising a composition of the formula $[R(OCH_2CH_2)_nX]_aM_b$, where R is an alkyl group having from eight to eighteen carbon atoms; n is an integer from 0 to 10; X is selected from the group of $SO_3^{2-}$, $SO_4^{2-}$, $CO_32-$ and $PO_4^{3-}$; M is an alkali metal, alkaline earth metal, ammonium derivative or amine derivative; a is the valence of M and b is the valence of $[R(OCH_2CH_2)_nX]$.

25. The method of claim 22, wherein the surfactant is a foaming agent comprising a composition of the formula $[R—CH{=}CH(CH_2)_m—X]_aM_b$, where R is an alkyl group having from eight to eighteen carbon atoms; m is an integer from 0 to 3; X is selected from the group of $SO_3^{2-}$, $SO_4^{2-}$, $CO_3^{2-}$ and $PO_4^{3-}$, M is an alkali metal, alkaline earth metal, ammonium derivative or amine derivative; a is the valence of M and b is the valence of $[R—CH{=}CH(CH_2)_m—X]$.

26. The method of claim 22 wherein said surfactant comprises a compound of the formula R—OH, where R is an alkyl group having from eight to sixteen carbon atoms.

27. The method of claim 22, wherein said first aqueous solution additionally comprises a lithium hypochlorite in amounts of up to 10% of the chloroisocyanuric acid salt.

28. A kit for providing a decontamination composition comprising the following components in packaged form:

(a) a decontaminant comprising chloroisocyanuric acid; or its alkali metal or alkaline earth metal salt or a substance thereof;

(b) a co-solvent selected from the group consisting of polypropylene glycols, polyethylene glycols, and derivatives and mixtures thereof;

(c) a surfactant; and (d) a mixture of sodium tetraborate decahydrate, anhydrous sodium carbonate and sodium hydroxide.

29. A kit as claimed in claim 28, wherein said decontaminant further includes lithium hypochlorite.

30. A kit as claimed in claim 28, wherein said chloroisocyanuric acid is sodium dichloroisocyanurate.

31. A kit as claimed in claim 28, wherein said surfactant comprises a composition of the formulae $[R(OCH_2CH_2)_nX]_aM_b$, where R is an alkyl group having from eight to eighteen carbon atoms; n is an integer from 0 to 10; X is selected from the group of $SO_3^{2-}$, $SO_4^{2-}$, $CO_3^{2-}$ and $PO_4^{3-}$; M is an alkali metal, alkaline earth metal, ammonium derivative or amine derivative; a is the valence of M and b is the valence of $[R(OCH_2CH_2)_nX]$.

32. A kit as claimed in claim 28, wherein said surfactant comprises a composition of the formulae $[R—CH{=}CH(CH_2)_m—X]_aM_b$ where R is an alkyl group having from eight to eighteen carbon atoms; m is an integer from 0 to 3; X is selected from the group of $SO_3^{2-}$, $SO_4^{2-}$, $CO_3^{2-}$ and $PO_4^{3-}$, M is an alkali metal, alkaline earth metal, ammonium derivative or amine derivative; a is the valence of M and b is the valence of $[R—CH{=}CH(CH_2)_m—X]$.

33. A kit as claimed in claim 28, wherein said surfactant comprises a compound of the formula R—OH, where R is an alkyl group having from eight to sixteen carbon atoms.

34. A kit as claimed in claim 28, wherein said composition components (a) and (b) are individually packaged and components (c) and (d) are packaged as a mixture or components (a) and (d) are packaged as a mixture and components (b) and (c) are packaged as a mixture.

35. A kit as claimed in claim 28, wherein said composition components are individually packaged.

36. A method for decontaminating surfaces comprising the steps of:

(a) preparing a decontamination formulation of from about 1% to about 15% by weight of a chloroisocyanuric acid salt, from about 1% to about 10% by volume of a co-solvent selected from the group consisting of polypropylene glycol, polyethylene glycol, and derivatives thereof and mixtures thereof, from about 1% to about 15% by volume of a surfactant, and a buffer to initially maintain said formulation at a pH from about 11 and which fails over time allowing the pH to fall to a pH of about 8.5 and water to form an aqueous solution; and (b) applying the aqueous solution to contaminated surfaces.

37. The decontamination method of claim 36 wherein the buffer maintains the pH of the aqueous solution above 8.5 for at least 30 minutes.

38. The decontamination method of claim 36 further comprising the steps of:

(a) foaming the aqueous solution; then (b) applying the foamed aqueous solution to the contaminated surface.

39. The decontamination method of claim 38 wherein the foaming step comprises dispensing the aqueous solution through an aeration nozzle.

40. The decontamination method of claim 39 wherein the buffer maintains the pH of the aqueous solution above 8.5 for at least 30 minutes.

41. The decontamination method as recited in claim 36 wherein all of the chloroisocyanuric acid salt, co-solvent, surfactant, and the buffer are combined with water before applying to the contaminated surface.

42. The decontamination method as recited in claim 36 wherein (a) the co-solvent and surfactant are combined with water to form a non-degrading solution; and (b) the buffer and the chloroisocyanuric acid salt are added separately to the non-degrading solution before applying to the contaminated surface.

* * * * *